US007007979B2

(12) United States Patent
Mitchell

(10) Patent No.: US 7,007,979 B2
(45) **Date of Patent: *Mar. 7, 2006**

(54) ADVERTISING MATERIALS AND METHOD FOR COOPERATIVE PROMOTIONS

(75) Inventor: Robert E. Mitchell, Kenosha, WI (US)

(73) Assignee: Adams Enterprises, Inc., Carson City, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/767,183

(22) Filed: Jan. 29, 2004

(65) Prior Publication Data

US 2004/0217585 A1 Nov. 4, 2004

Related U.S. Application Data

(63) Continuation-in-part of application No. 10/409,367, filed on Apr. 7, 2003, which is a continuation-in-part of application No. 09/996,312, filed on Nov. 28, 2001, now abandoned, which is a continuation of application No. 09/799,447, filed on Mar. 5, 2001, now Pat. No. 6,340,179, which is a continuation of application No. 09/584,030, filed on May 30, 2000, now abandoned.

(51) Int. Cl.
*B42D 15/00* (2006.01)

(52) U.S. Cl. ..... 283/67; 283/56; 283/51

(58) Field of Classification Search ..... 283/67, 283/56, 51, 70, 61, 117, 901, 903; 705/14
See application file for complete search history.

(56) References Cited

U.S. PATENT DOCUMENTS

| | | | | |
|---|---|---|---|---|
| 5,002,313 | A * | 3/1991 | Salvatore | 283/102 |
| 5,368,129 | A * | 11/1994 | Von Kohorn | 186/52 |
| 5,780,133 | A * | 7/1998 | Engstrom | 428/40.1 |
| 5,822,735 | A * | 10/1998 | De Lapa et al. | 705/14 |
| 5,921,584 | A * | 7/1999 | Goade, Sr. | 283/107 |
| 6,340,179 | B1 * | 1/2002 | Mitchell | 283/67 |

* cited by examiner

*Primary Examiner*—Willmon Fridie, Jr.
(74) *Attorney, Agent, or Firm*—Lesavich High-Tech Law Group, P.C.; Stephen Lesavich

(57) ABSTRACT

Advertising materials are provided for cooperative promotions. The materials comprise of a set of print or electronic coupons printed on removable tabs and a promotional piece or flare. Each coupon entitles its purchaser to a substantial discount on a product. Selected coupons entitle its purchaser to a prize. Multiple break-open windows are formed on the coupons and are movable between closed and open positions respectively concealing and revealing outcome-determining indicia. The indicia comprise symbol combinations and identify respective coupons as either losers or winners entitled to pre-determined awards. A cooperative promotional method utilizing the advertising materials is also disclosed.

30 Claims, 18 Drawing Sheets

ADVERTISING MATERIALS AND METHOD FOR COOPERATIVE PROMOTIONS

CROSS REFERENCES TO RELATED APPLICATIONS

This U.S. application is a Continuation-In-Part of U.S. application Ser. No. 10/409,367, filed Apr. 7, 2003, which is a Continuation-In-Part of U.S. application Ser. No. 09/996,312, filed Nov. 28, 2001, now abandoned, which is a Continuation of U.S. application Ser. No. 09/799,447, filed Mar. 5, 2001, that issued into U.S. Pat. No. 6,340,179 B2, on Jan. 22, 2002, which was a Continuation of U.S. application Ser. No. 09/584,030 filed on May 30, 2000, now abandoned.

FIELD OF THE INVENTION

The present invention relates generally to advertising. More specifically, it relates to advertising materials and methods for cooperative promotions.

BACKGROUND OF THE INVENTION

Advertising is a major part of the economy. It plays a significant role in the solicitation of customers for a wide range of commercial enterprises providing various types of goods and services.

One overall objective of an advertising campaign is generally to sell the goods and/or services of the advertiser. A normal strategy for accomplishing this objective is to communicate with customers and potential customers, thereby inducing purchases through a combination of information and persuasion.

A significant challenge faced by advertisers is attracting the attention of prospective customers. Various advertising techniques have been developed to attract the attention of potential customers. Discounted pricing is a common example and can take many forms. For example, reduced-price "sales" are extensively and repeatedly conducted by many mass merchandisers. Discount coupons are also extensively used in merchandising. A typical discount coupon allows a purchaser to obtain a given product at a reduced price, or provides some additional consideration. Rebates comprise yet another form of price discounting.

Another popular advertising technique involves a game or contest played by prospective customers and resulting in monetary or other prizes and awards. Mass merchandisers have employed a number of different promotional methods and types of promotional materials which entertained and motivated prospective customers through the use of such awards. The element of chance in providing such awards tends to stimulate player interest and contributes to the entertainment function of the game materials.

Historically, advertisers have been extremely successful in bringing attention to their products to consumers through sweepstakes or "in-pack" game of chance promotions. Consider the success of Fortune 500 companies such as McDonalds® with its Monopoly® promotion that has been running twice a year for many years. However, most in-pack chance promotions have been costly, prohibiting most advertisers from participating.

It would be desirable to provide an advertising system and method which combines the co-promotional features of coupons sold and the player entertainment of a sweepstakes that may include a game of chance.

SUMMARY OF THE INVENTION

In accordance with preferred embodiments of the present invention, some of the problems associated with advertising and promotional systems are overcome. Advertising materials and a method for cooperation promotion is presented.

Advertising materials with multiple break-open tabs including at least one coupon printed thereon where the multiple break-open tabs are movable between closed and open positions respectively concealing and revealing outcome-determining indicia. The indicia comprise various symbol combinations of numbers, letters and symbols and identify respective coupons as either losers or winners entitled to pre-determined awards. A cooperative promotional method utilizing the advertising materials is also disclosed. The advertising materials include paper and electronic advertising materials.

The foregoing and other features and advantages of preferred embodiments of the present invention will be more readily apparent from the following detailed description. The detailed description proceeds with references to the accompanying drawings.

BRIEF DESCRIPTION OF THE DRAWINGS

Preferred embodiments of the present invention are described with reference to the following drawings, wherein.

DETAILED DESCRIPTION OF PREFERRED EMBODIMENTS

I. Environment

Figure 1A:
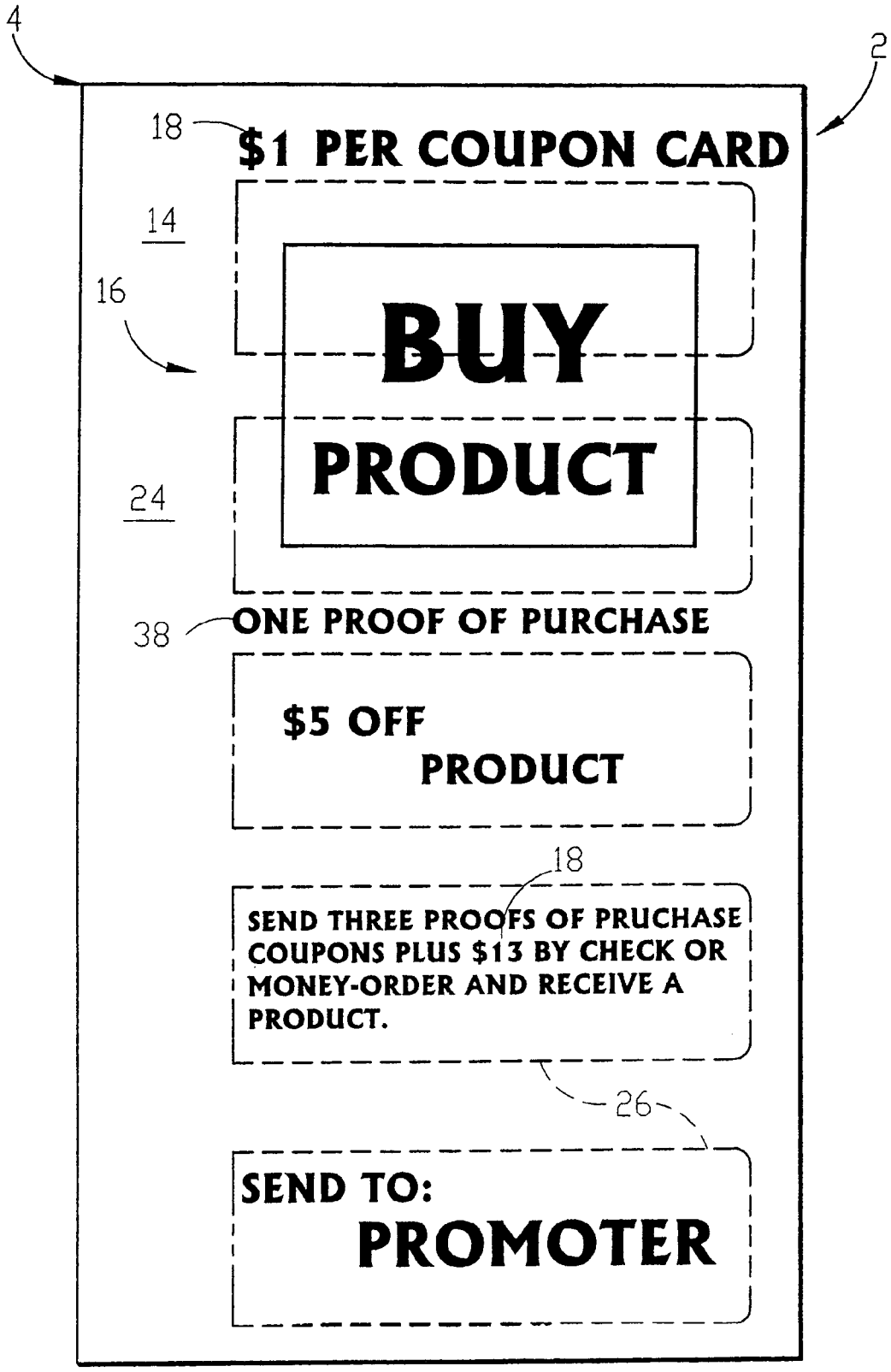
FIG. 1*a* is a front elevational view of a coupon card of a set of advertising materials, illustrating windows thereof in their closed positions.
Figure 1B:
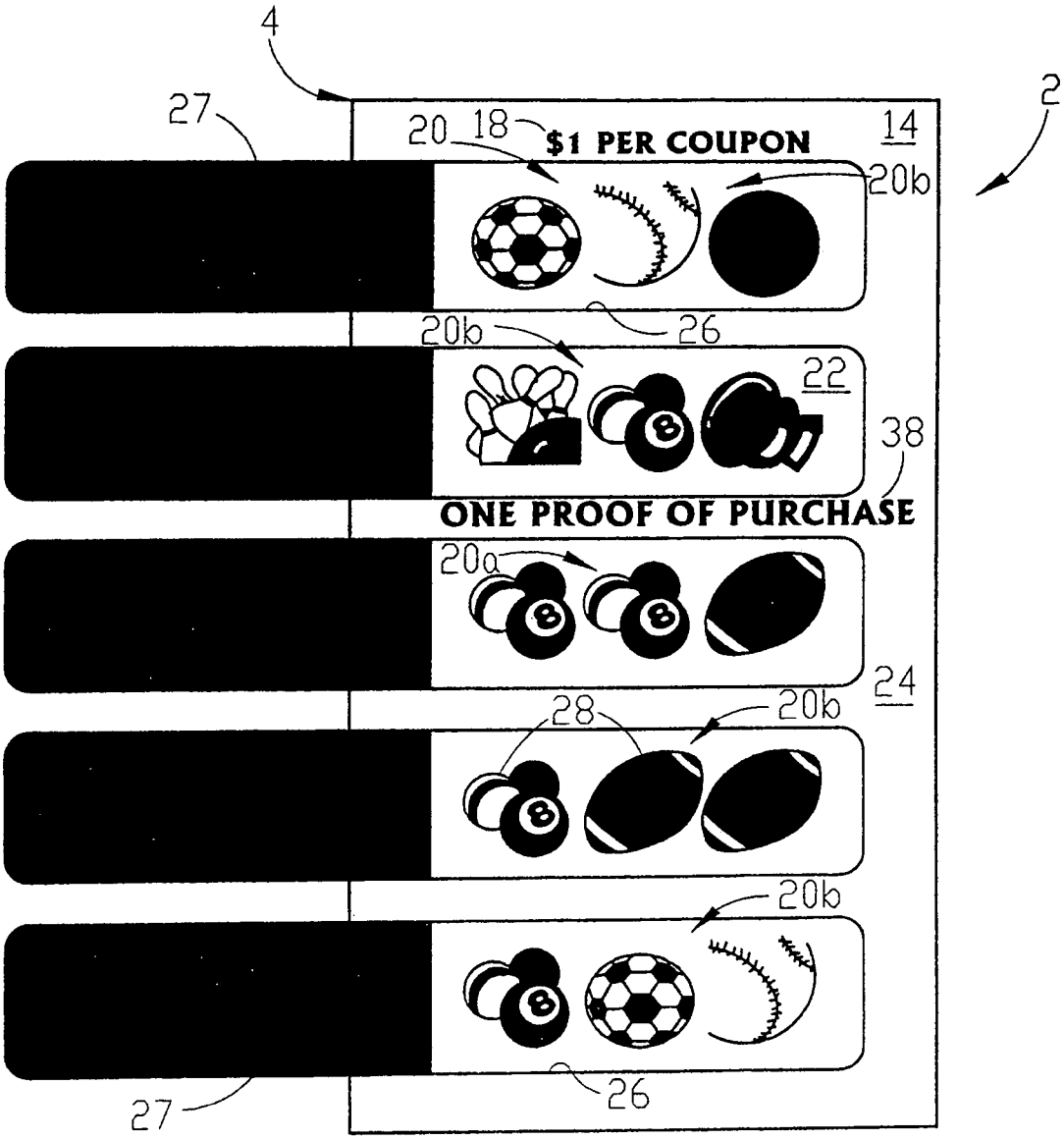
FIG. 1*b* is a front elevational view of the coupon card, showing the windows in their open positions.
Figure 2:
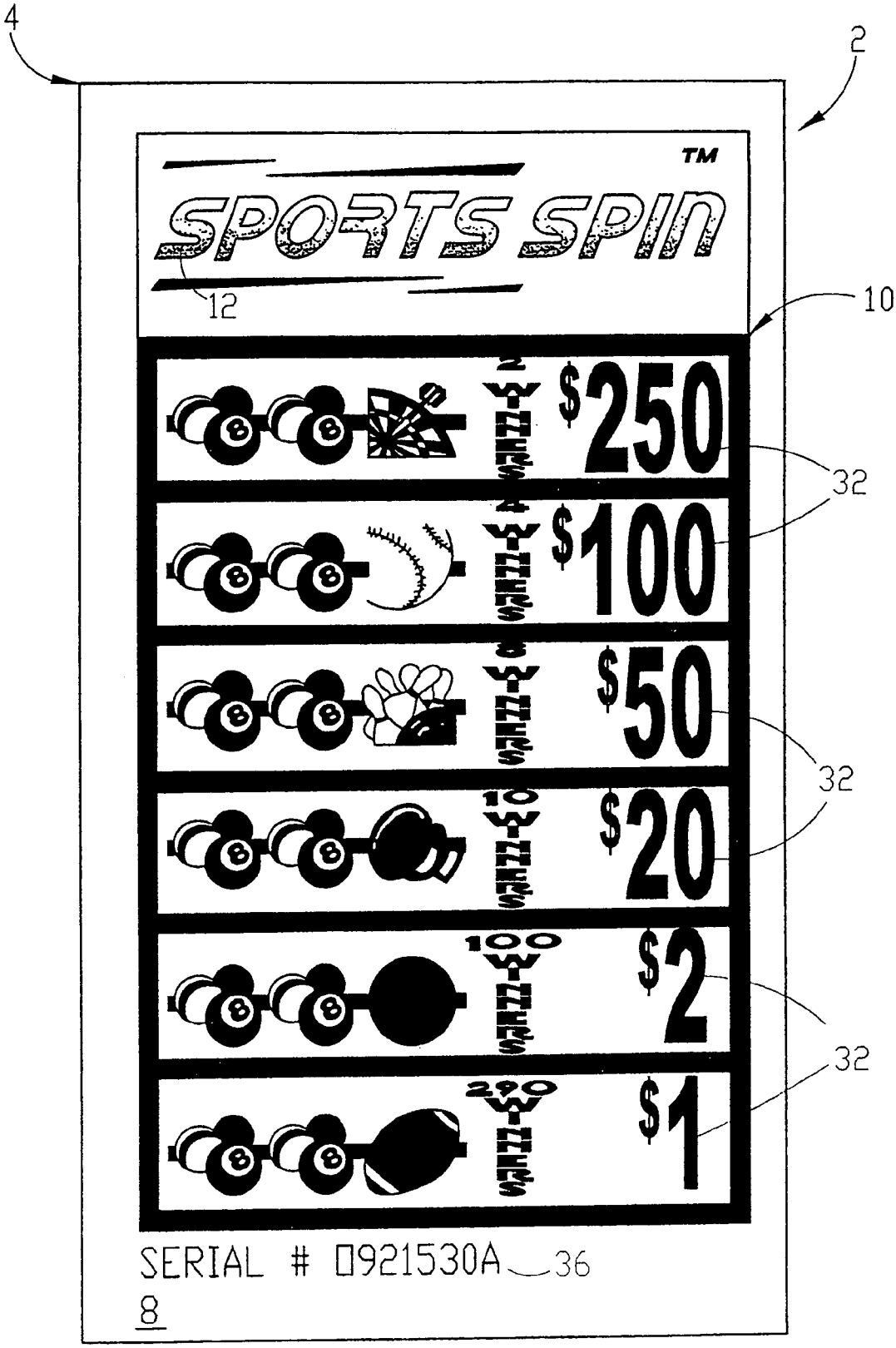
FIG. 2 is a rear elevational view of the coupon medium.

Referring to drawings in FIGS. 1 and 2 in more detail, the reference numeral 2 generally designates a set of advertising materials and reference numeral 4 generally designates a coupon card 4 for one embodiment of the present invention.

One embodiment of the invention includes cost-effective, in-pack chance promotion advertising materials 2 and coupon cards 4 for getting a product noticed while having a coupon offer "bill-boarded" in many co-operating retail venues.

The advertising materials 2 with the coupon cards 4 provide the ability to precisely target and market with a promotional product. A coupon card 4 can also include a sweepstakes game attached having the prizes paid for by the retailers, not the advertiser. The retailers help co-promote the advertiser.

The prospective shoppers actually buy the coupon cards 4 because, along with the coupon, they receive a free chance to win cash or prizes. The shoppers pull open the coupon tabs as explained below to see if they've won a prize in the sweepstakes. The promotion typically runs for a limited period of time (e.g., four-month period of time). Therefore, prospective shoppers are seeing the advertisement materials 2 repeatedly as they continue to participate in promotion via the coupon cards 4.

The advertising materials 2 and coupon cards 4 may display an advertiser's logo and promotional message on the front, back, and inside in addition on posters or flares 6 plus "notice to shoppers" and other point of sale materials as is explained below.

The coupon cards 4 may be a popular product for retailers offering shoppers discount coupons and a chance to win instant cash. Customers typically enjoy entertainment and monetary value that coupon cards 4 provide. Retailers typically enjoy an increased profit selling the coupon cards 4.

Returning now to FIG. 1, the advertising material set 2 can be used, for example, for cooperative promotions among different business entities. The advertising material set 2 includes, but is not limited to, artwork depicting sweepstakes products, goods or services for sale, discount off products, and other types of advertising materials.

The advertising material set 2 generally comprises plural coupon cards 4 comprising a coupon set. Typical sets of coupons range from several hundred to several thousand or more. The advertising materials also include a display or flare 6 (FIG. 3) for promoting sales of the coupon cards 4 and any associated games of chance and for identifying an award structure.

In one embodiment of the present invention, the advertising material set 2 includes paper, cardboard or plastic cards of various shapes, sizes and colors with plural break-open windows as is described below. In another embodiment of the present invention, the advertising material set 2 is electronic and is displayed graphically on a display device terminal or display device as is described below.

II. Coupon Cards 4

The coupon set includes a predetermined number of coupon cards 4, with an award structure comprising predetermined numbers of winning game pieces of different award amounts. Without limitation on the generality of various award structures, an exemplary disclosed game, for example, used with the coupon card 4 provide for two winners of $250 each, four winners of $100 each, eight winners of $50 each, ten winners of $20 each, one hundred winners of $2.00 each and two hundred and ninety winners of $1.00 each. The winning game pieces attached to coupon cards 4 are disbursed among a total of 3,078 coupon cards 4 in the entire coupon set. The coupons have selling prices of, for example, $1.00 each. However, this award structure is exemplary only and other award structures can also be used to practice the invention.

Each coupon card 4 has a back face 8 (FIG. 2) with the attached award structure 10 of award values 32 printed thereon. A name of a promotion (e.g., "Sports Spin") 12 is also printed on the back face 8.

A front face 14 of the coupon card 4 (FIG. 1A) also includes product advertising 16 printed thereon and a selling price 18 for the coupon card 4. The product advertising 16 can comprise a "proof-of-purchase" form 38 wherein customers are required to purchase a predetermined number of coupon cards 4 (e.g., three) in order to receive favorable pricing on an advertised product. As used herein, "product" refers to goods and/or services.

The coupon cards 4 include structure (FIG. 1B) for selectively concealing indicia 20 for determining an award, if any, for the customer. Thus, the indicia 20 include both "win" 20*a* and "lose" 20*b* indicators.

In the illustrated embodiment, the coupon cards 4 are two-ply construction of paper, cardboard, plastic, etc. or other suitable materials with back and front panels 22, 24 providing the back and front faces 8, 14 respectively. The indicia 20 are printed on the inside face of the back panel 22 and are selectively concealed by break-open windows 26 or some other break-open structure formed in the front panel 24. The break-open windows 26 have closed and open positions respectively concealing and revealing the indicia 20 by means of removable coupons 27. The break-open windows 26 are movable between closed positions concealing respective indicia 20 and open positions revealing same.

In one embodiment of the invention, the break-open windows 26 are perforated tabs that can be removed from the coupon cards 4 and used as coupons. In one embodiment of the invention, the proof of purchase statement 38 is printed on a break-open window 26 and is a perforated removable tab that can be removed from the coupon cards 4 and saved.

Each indicia 20 (FIG. 1A) comprises plural (e.g. three are shown) symbols 28, with certain symbol combinations comprising winners (e.g., 20*a*, one dollar winner) associated with respective award values 32 (FIG. 2). A serial number 36 associated with the advertising material set 2 is printed on the back face 8 of each coupon card 4. A proof of purchase statement 38 is printed on the front face 14 of each coupon card 4 and serves to remind the purchaser of the value of the coupon card 4.

In one embodiment of the present invention, the proof of purchase statement 38 includes a hologram. In another embodiment of the invention, magnetic or other specialized ink is used. However, other types of proof of purchase statements 38 can also be used (e.g., regular ink, etc.) and the present invention is not limited to the proof of purchase statements 38 described.

Various other structures and devices for selectively concealing the indicia 20 can be employed with the present invention and the present invention is not limited to the components described. The disclosed exemplary construction is relatively efficient and cost effective. Moreover, the two-ply panel paper, cardboard, plastic, etc. construction employed provides ample area for multiple break-open windows 26, such as the five which are shown (FIG. 1B). However, the present invention is not limited to the exemplary materials described and other materials can also be used for coupon cards 4.

In another embodiment of the present invention, the indicia 20 are electronic and are displayed graphically on a display device or display terminal and selected and opened graphically as is described below.

III. Flare 6

The flare 6 (FIG. 3) includes a front face 30 with the award structure 10 printed thereon. The award structure 10 comprises the award values 32, the winning indicia 20*a*, and the number of winners entitled to each award value 32, identified by the reference numeral 34. The promotion name 12 is also prominently displayed on the flare 6. As shown, the higher award values 32 are very prominently displayed in order to attract customer interest. The serial number 36 printed on the individual coupon cards 4 is also printed on the flare front face 30.

The flare 6 includes: (1) posters; (2) table tents; (3) stickers; (4) coasters; and (5) vending machine signage. These flares 6 explain the coupon cards 4, how to use the coupon cards 4, how to redeem the coupons, how to win, expiration date of promotion, game sweepstakes payout structure, products being advertised, discount off products, etc.

However, the present invention is not limited to such flares 6 and other types of flares 6 can also be used to practice the invention.

IV. Cooperative Promotional Methodology

Figure 4:
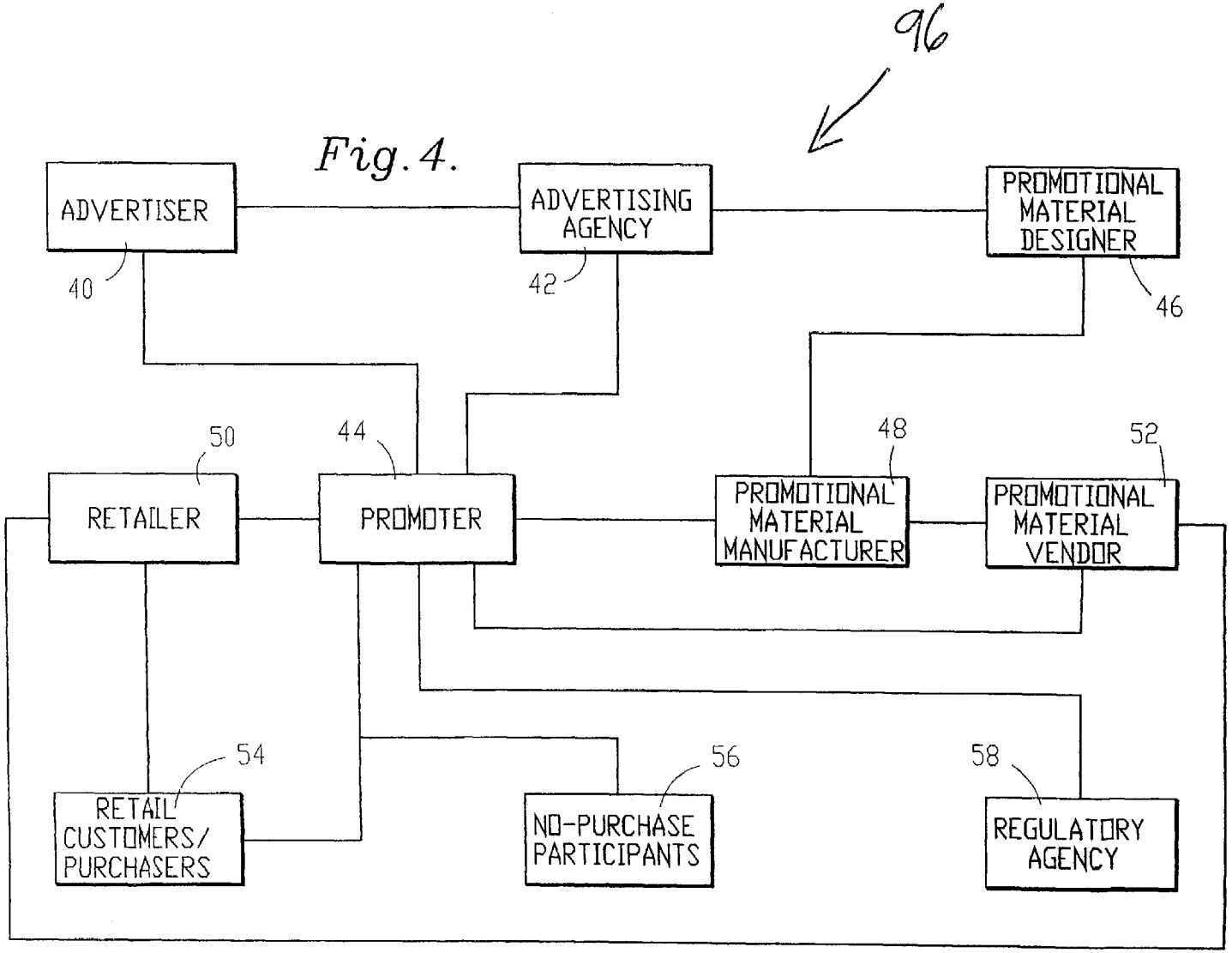
FIG. 4 is a schematic diagram of various entities involved in the cooperative advertising method of the present invention.

A cooperative promotional advertising method using the advertising material set 2 is disclosed. FIG. 4 is a schematic diagram 96 of the main participants. An advertiser 40 can be any entity with a product, i.e. goods and/or services, to sell. The advertiser 40 can involve an advertising agency 42, which would engage the promoter 44. Alternatively, the advertiser 40 can deal directly with the promoter 44. The first advertiser 40 and the promoter 44 are illustrated as different entities. However, the first advertiser 40 and the promoter 44 can also be the same entity. The advertising materials 2 are designed by a material designer 46 for production by a material manufacturer 48. A design for the advertising materials 2 would include such features as the name, the total coupon count, the award structure, the graphics, and the product advertising 16.

In addition to arranging for the advertising materials 2, the promoter 44 arranges for their distribution to retail entities 50. Since the retail entities 50 sell the coupon cards 4 in order to generate revenue and also to increase traffic in their establishments, the retailers 50 comprise a second or additional advertiser or second promoter whereby a synergistic, co-promotion of goods and services of the primary advertiser 40 and the retailer 50 is achieved. The advertising materials 2 can be provided to the retailer 50 by a vendor 52, such as a distributor who represents a game manufacturer.

Customers 54 of the retailer 50 can comprise the purchasers of the coupon cards 4. Thus, the retailers 50 can be carefully chosen for their customer profiles and demographics. For example, the goods and/or services of the advertiser 40 can be matched with retailers 50 whose customers 54 would be most likely to purchase the advertised goods and/or services from the coupon cards 4. The advertised goods and/or services can correspond to the goods and/or services of the retailer 50 whereby significantly greater redemption of the coupon cards 4 can occur from a targeted group of potential customers 54. Moreover, retailers 50 with multiple retail store locations can carry the materials 2, and can distribute same according to the demographics of their various locations.

Serial numbers 36 provide a means for tracking the sales of the advertising material sets 2. For example, the promoter 44 can monitor the volume of redeemed coupon cards 4, and using the serial numbers 36 printed thereon, can determine which retailers 50 received the corresponding advertising material sets 2 from which the redeemed coupon cards 4 were sold. Such information can be utilized to quantitatively monitor the success of the entire advertising campaign. Valuable market research can be generated thereby.

In addition to the regular retail customers 54 who purchase the coupon cards 4, if the coupon cards 4 include a game of chance, gaming laws and regulations in some areas require that the coupon cards 4 also be available to participants 56 who do not make purchases. Such no-purchase participants 56 can be accommodated by the promoter 54, who can receive their "entries" in the promotion and make awards as appropriate. The promoter 44 can also handle regulatory agency 58 approvals, permits, licenses, etc.

Figure 5:
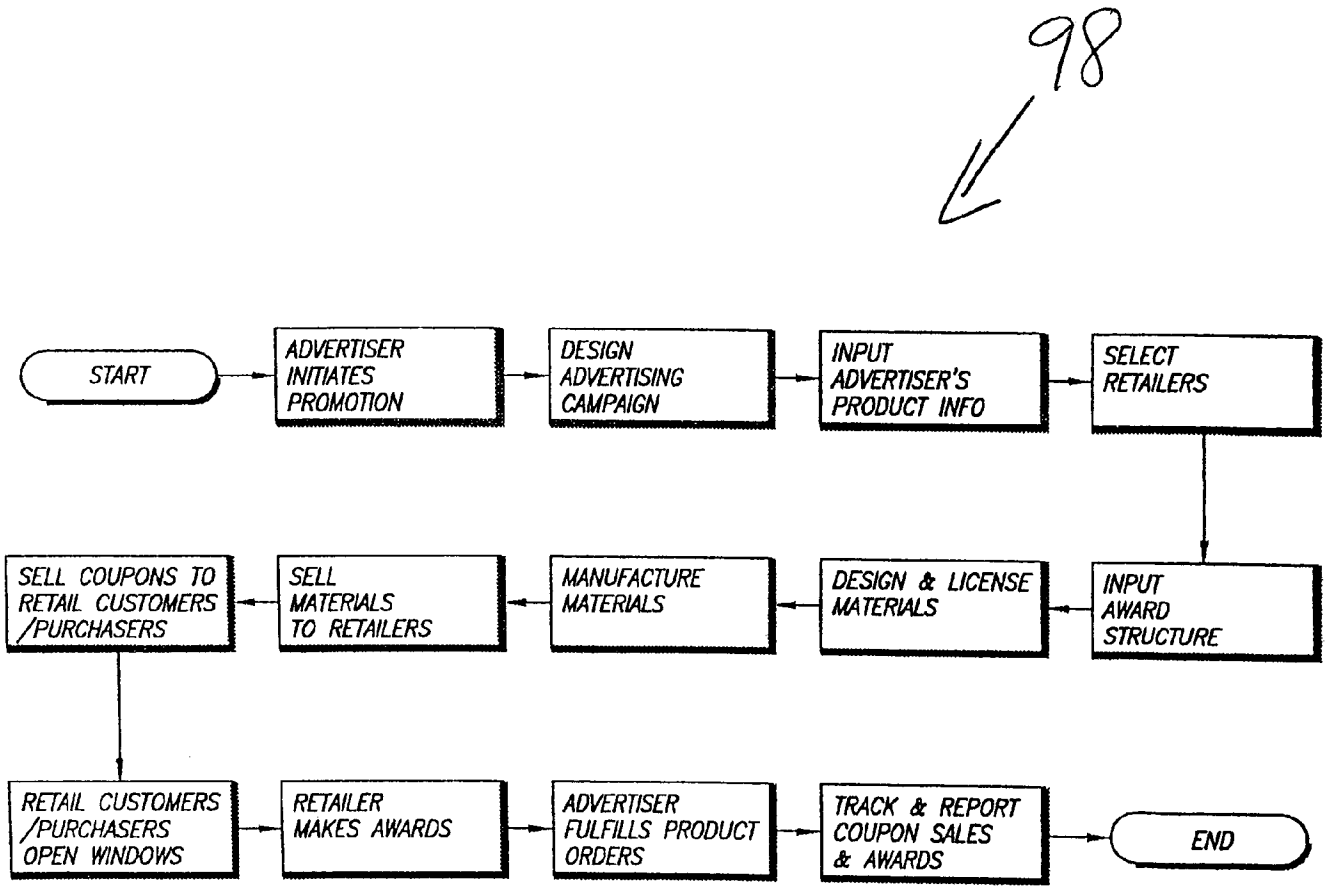
FIG. 5 is a flow chart depicting a cooperative advertising method of the present invention.

FIG. 5 is a flow chart 98 illustrating a co-promotional method of advertising of the present invention. The method is started by an advertiser 40 initiating a promotion of its goods and/or services. An advertising campaign is designed, with input from the product information provided by the advertiser 40. The retailers 50 are selected according to various demographic, marketing and related criteria. The design and license of the award structure and the advertising/promotional materials 2 is accomplished to most effectively market the goods and/or services of the promoter 44 and to create the broadest possible appeal to the customers 54 of the retailers 50. The materials 2 are manufactured by a material manufacturer 48 and are sold and distributed to the retailers 50 through a network of vendors or distributors 52.

At the retail level the coupon cards 4 are sold to the retail customers 54. The retailers 50 can participate in the promotion of the coupon cards 4 by displaying the advertising flares 6 associated therewith and by various other advertising methodologies, including print, broadcast media, direct mail, electronic (e.g., e-mail, etc.), etc.

The coupon cards 4 including game pieces are played by the customers 54 who receive awards from the retailers 50. Since coupon card 4 has a value in excess of its purchase price, the customers 54 are enticed to order the goods and/or services promoted thereon from the advertiser 40 identified thereon. Moreover, a significant entertainment component is provided in the course of playing the materials 2 since the element of chance adds considerably to the interest and motivation of the customers 54.

Finally, the advertiser 40 can take advantage of the sales data by tracking serial numbers 36 of coupon cards 4 redeemed and thereby determine which retail establishments 50 are most effective for the purposes of the promotion. For example, geographic locations, types of retail establishments and other factors can be taken into account whereby the advertiser 40 can maximize its revenue from conducting such promotions.

V. First Alternative Embodiment Advertising Material Set 102

The reference numeral 102 (FIG. 6A) generally designates an advertising material set comprising a first modified or alternative embodiment of the present invention. The advertising material set 102 includes multiple coupon cards 104 and a display or flare, such as shown at 6.

Figure 6A:
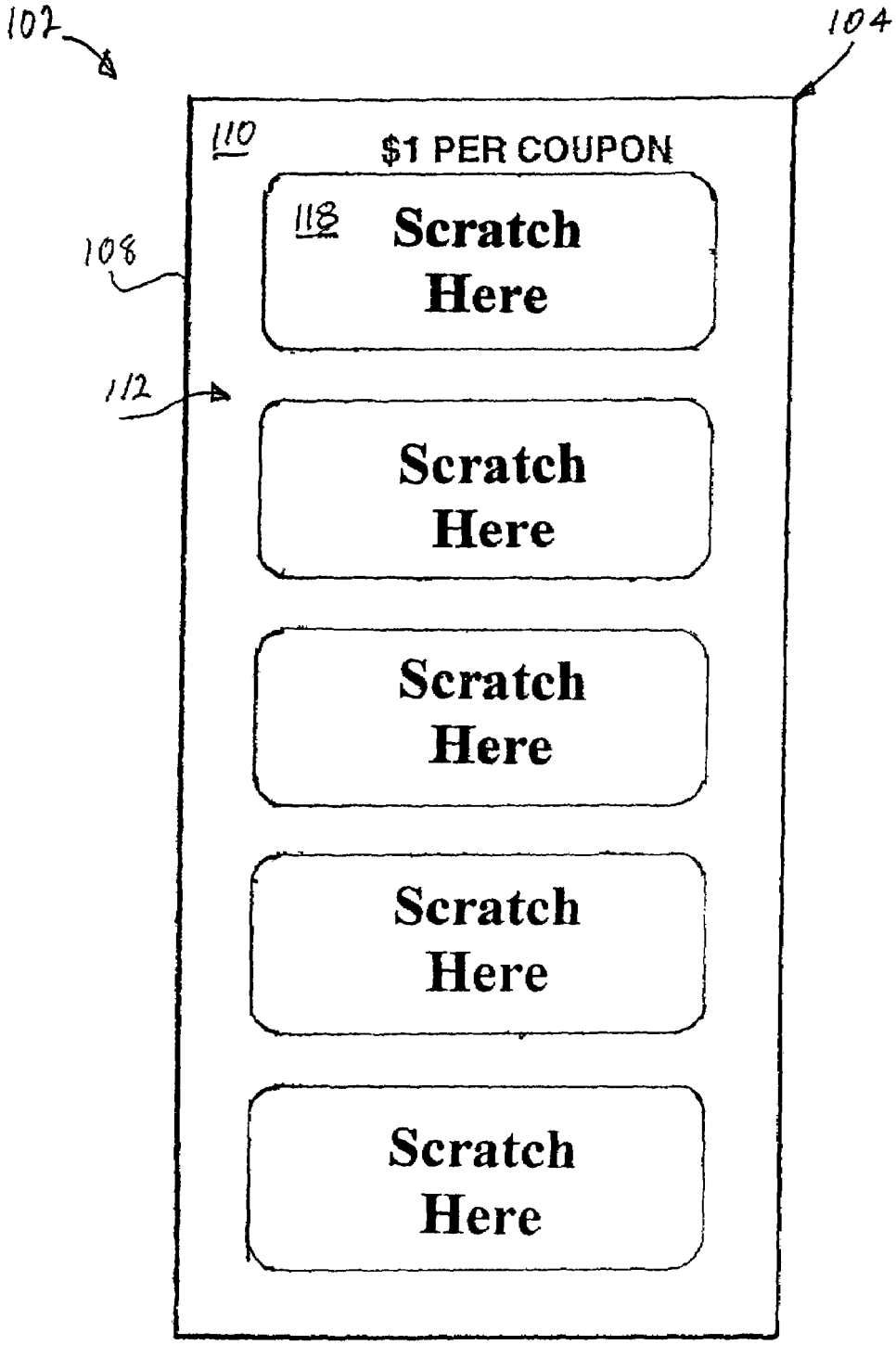
FIG. 6A is a front elevational view of a coupon medium of a set of advertising materials embodying the present invention, showing break-open tabs thereof in their closed positions.
Figure 6B:
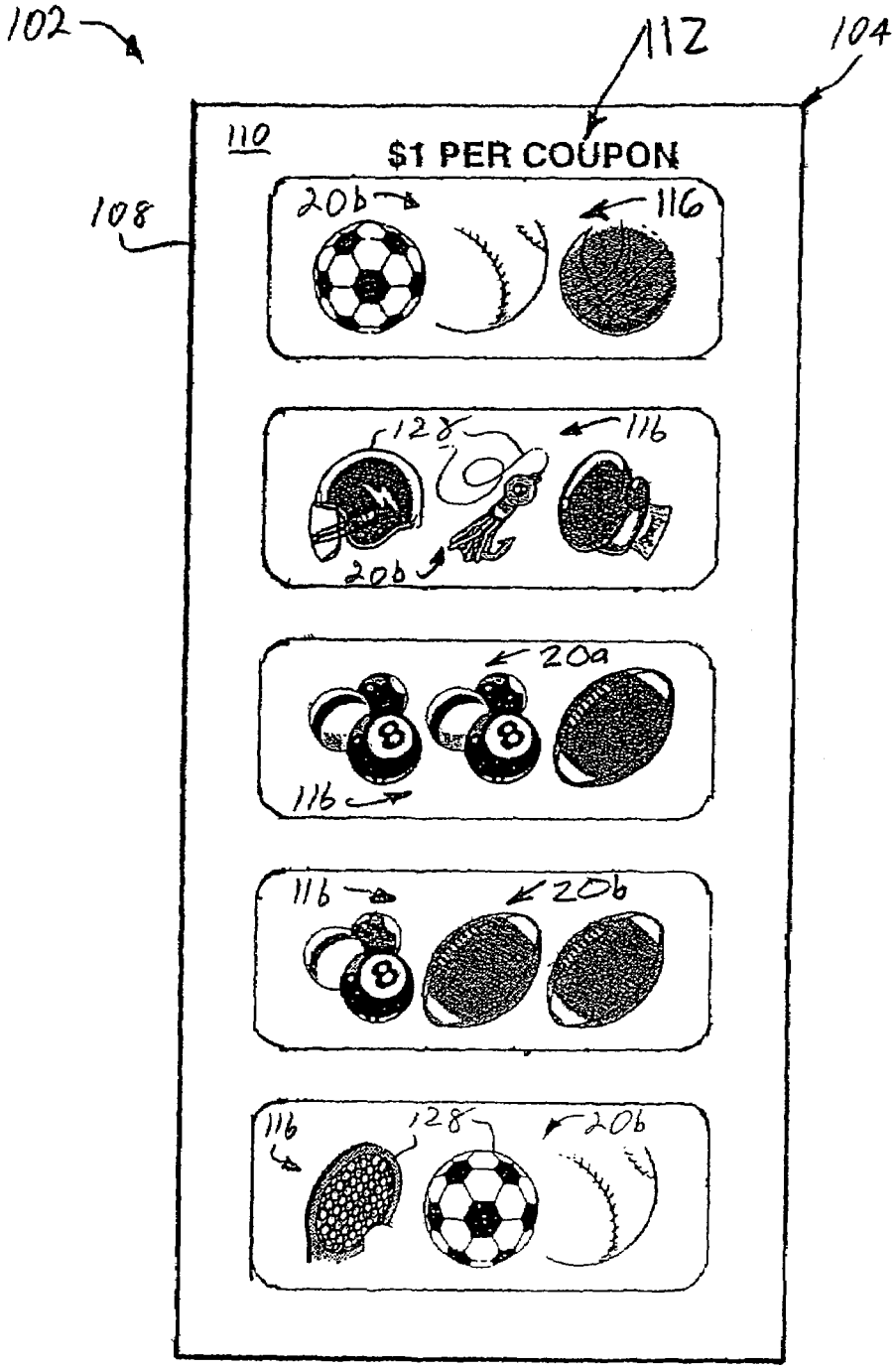
FIG. 6B is a front elevational view of the coupon medium, showing break-open coupons in their open positions.
Figure 7:
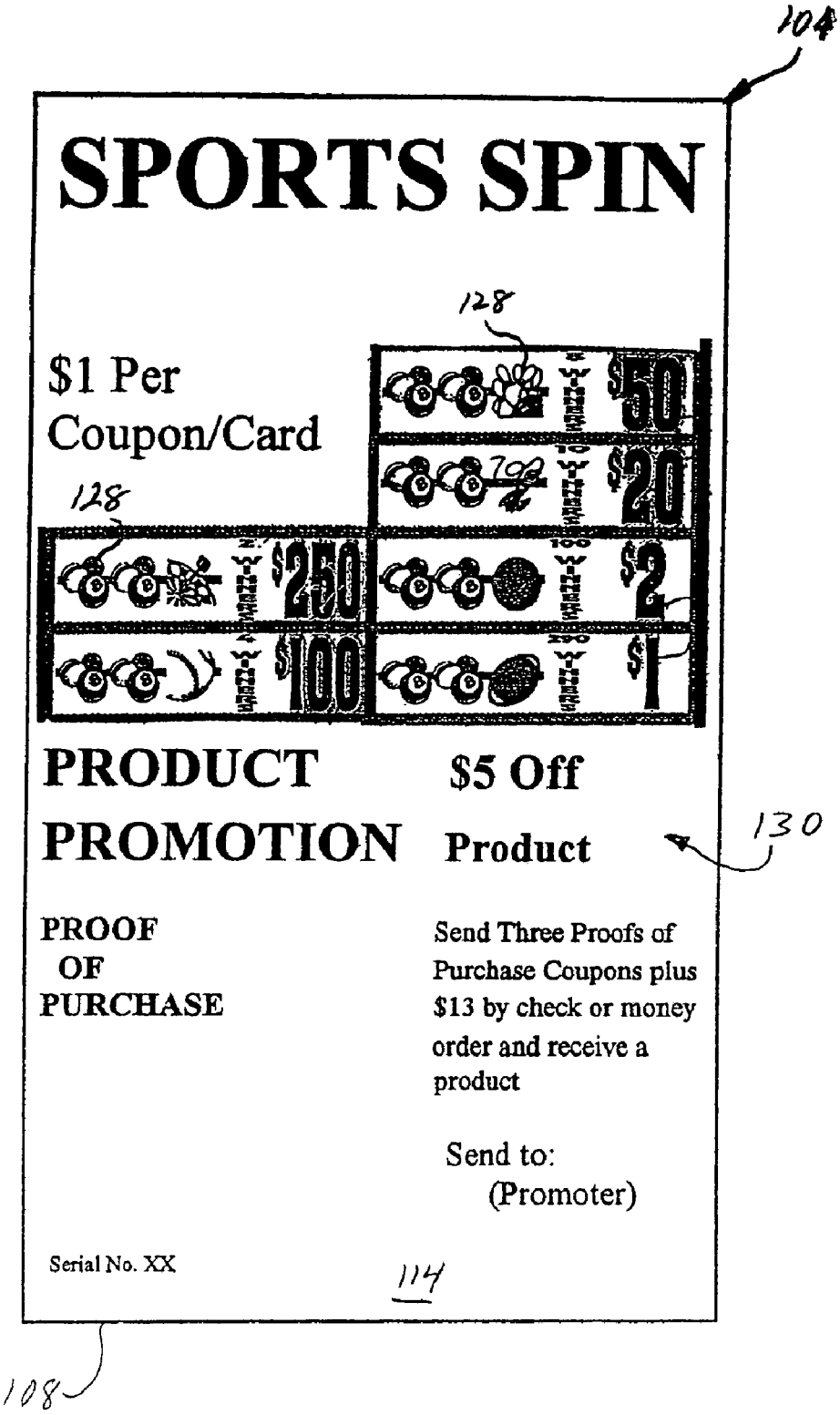
FIG. 7 is a rear elevational view of a scratch-off coupon medium.

The coupon cards 104 comprise a type of construction generally known as a "scratch-off" configuration. They are commonly used for conducting lotteries, sweepstakes, drawings, instant-winner games and various other gaming methodologies requiring the concealment of indicia for exposure by a player. Such construction is typically multi-layered as shown in FIGS. 6*a*, 6*b* and 7. The coupon cards 104 have similar or identical features to those described for coupon cards 4.

Each coupon includes a cardstock base 108 with front face 110 having graphic and textual information and artwork 112 printed thereon. The information/artwork 112 can include game and/or promotional information, such as discount coupon value, merchandise and services for which the coupons can be applied, etc. Printed on a front face 110 are outcome information/artwork 116 which, like the coupon cards 104 described above, can determine the outcome of the promotional game and communicate to the coupon holder what he or she has won, if anything. Hence, the outcome information/artwork 116 can include the printed symbols 128 as shown in FIG. 7.

Various symbol combinations and outcome protocols can be utilized. For example, winning 20*a* and losing indicia 20*b*, respectively, such as those described above, can be printed on the coupon front face 110.

A concealing, frangible coating 118 is placed over the front fact 110 for temporarily covering and concealing the outcome information/artwork 116. Such coatings 118 are well known and can include any suitable material, such as various other dry coatings, plastics, foil, etc. The outcome information/artwork 116 can also be concealed electronically (e.g., via computer graphics, etc.) in an electronic version.

The concealing coating 118 is opaque whereby the outcome information/artwork 116 cannot be discerned in advance. Printed on the back face 114 are graphic and textual information and artwork 130.

In one embodiment, coupon cards 104 include a perforation that allows the coupon card 104 to be torn in half. For example, FIG. 7 illustrates a lower half of coupon card 104 as a proof of purchase 38 that can be removed and used by a consumer and an upper half that includes award values 32 printed thereon.

VI. Second Alternative Embodiment Promotional System 202 and Methodology.

Figure 8:
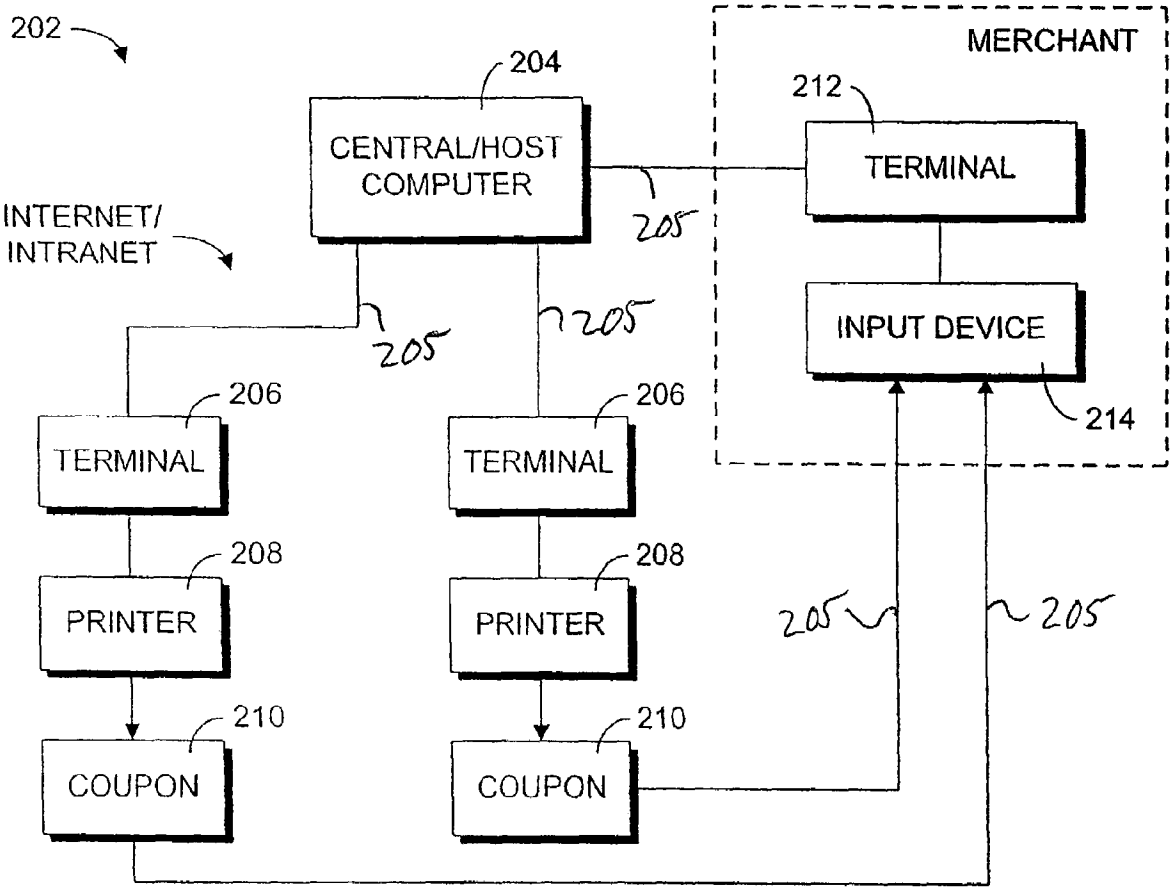
FIG. 8 is schematic diagram of a promotional coupon dispensing system utilizing computerized equipment that has sweepstakes capacity.

The reference number 202 generally designates a promotional coupon distribution system comprising a second modified or alternative embodiment of the present invention as shown in FIG. 8. The promotional coupon distribution system 202 (hereinafter system 202) also includes a capacity to compute a gaming structure electronically. The system 202 includes a centralized host computer 204 with multiple smart terminals or computers 206 connected thereto by a suitable communications network, local computer network (e.g., intranet, LAN, etc.) or global computer network (e.g., Internet) 205 or other suitable means for transferring electronic data, such as wired communications, wireless communications, fiber optics, satellite transmission, etc. The central/host computer 204 stores data, e.g., files, relating to one or more promotional coupon offers and games being conducted according to the methodology of the present invention.

Consumers interface with the system 202 at the terminals 206 whereat they access the system, pay the required purchase amount for "tickets" or coupon cards 4, 104 (which can be electronic). The tickets or coupon cards 4, 104 can also be printed directly at retail sites using various secure printing methods (e.g., security thermal paper, conventional paper with pre-printed serial numbers 36, etc.). The host computer 204 also has gaming functions whereby an element of chance can be incorporated in each play of respective coupon or ticket electronically. A printer 208 associated with each terminal 206 can print a coupon 210 for merchandise or services or a discount therefore, by a player accessing the game system through a terminal 206.

In operation, the system 202 provides an electronic window off the promotional advertising and game materials described above, with additional benefits and features inherent in conducting such activities electronically. For example, the computer is well adapted to automatically generate random events and outcomes when a player accesses same through a respective terminal 206.

In addition, coupons 210 with concealed indicia 20 are displayed graphically on the terminals 206. The graphical coupons 210 are "broken-open" or "scratched-off" electronically by selecting corresponding graphical coupon 210 structures with a selection device (e.g., physical or graphical button, mouse, trackball, keyboard, touch screen, etc.) thereby selectively revealing concealed graphical indicia 20. The terminals 206 also graphically display the flare 6.

The electronic embodiment of the system 202 also relates to the merchant/redemption side, which can incorporate multiple merchant terminals 212 for tracking the redemption of the graphical coupons 210. For example, a consumer can present a coupon from a session terminal 206 at one or more merchant locations for redeeming goods and/or services thereat. The merchant can input information from the coupon 210 through an input device 214, such as a barcode reader, keyboard, key pad, touch screen, etc. Information from the graphical coupon 210 input through the input device 214 can be used for verification purposes, i.e., to authenticate the graphical coupon 210 to prevent repetitive uses, etc.

Moreover, the system 202 can interactively identify and monitor usage. Thus, patterns among consumers can be identified and tracked electronically. Such usage pattern data can be utilized by merchants, promoters, advertisers and other for tracking and reporting coupons sales awards in order to enhance and refine marketing strategies.

For example, the composition of electronic coupons can be instantly changed in response to changing spending habits among consumers for promotions, discounts, sales, liquidations and other marketing and promotional events and activities can efficiently be implemented on behalf of retailers and service providers through the promotional coupon distribution system 202.

A new promotion can be put in place electronically without having to go through the steps of printing and distributing same. Moreover, material wastage is substantially avoided because the coupons and tickets exist only electronically until purchased and printed by a consumer on demand, as contrasted to paper-based systems which typically involve printing and distributing large volumes of tickets and coupons. Such paper based systems inevitably involve a certain amount of waster material, delays, and inefficiencies.

VII. Removable Tabs with Break-Open Windows

Figure 3:
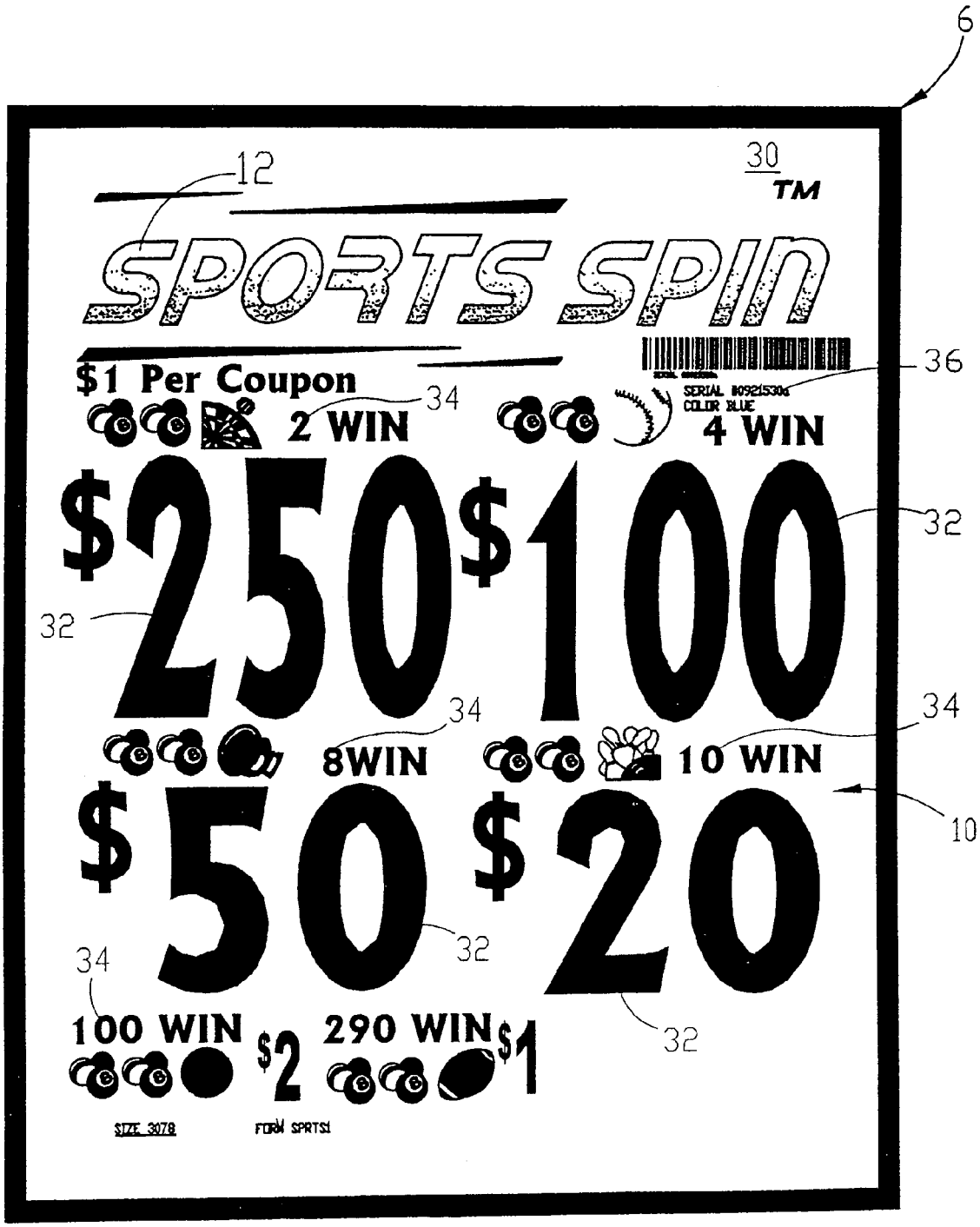
FIG. 3 is a front elevational view of a display or flare depicting the award structure of a game piece for the coupon medium.

In another embodiment of the present invention, another set of advertising materials set 2' includes multiple coupon cards 4' as illustrated in FIGS. 9–11 and a display or flare 6, such as is illustrated in FIG. 3.

Figure 9A:
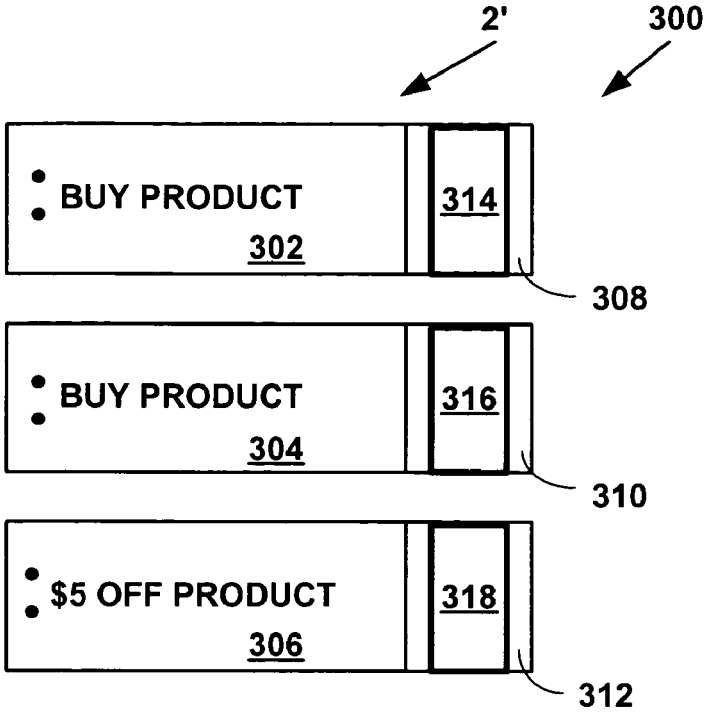
FIG. 9A is a top front view illustrating another set of advertising materials with plural removable coupons with break-open windows thereof in their closed positions.

FIG. 9A is a top front view 300 illustrating another set of advertising materials 2' with plural removable tabs 302, 304, 306 (three of which are illustrated for simplicity) with break-open windows 308, 310, 312, thereof in their closed positions. The set of advertising materials 2' are illustrated as separated. The break-open windows include break-open structures 314, 316, 318 that are explained below. However, the present invention is not limited to a set of advertising materials 2' with three removable tabs and more or fewer removable tabs can also be used.

Figure 9B:
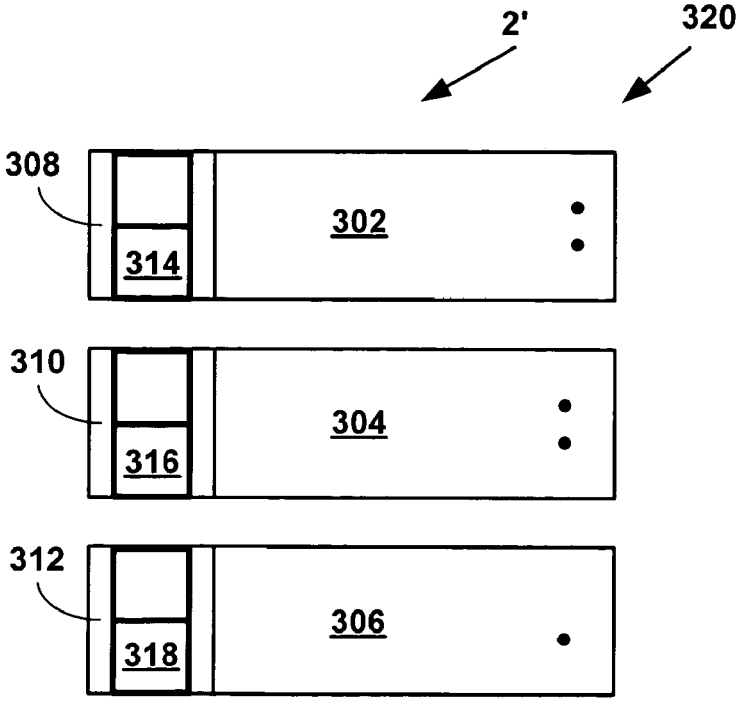
FIG. 9B is a top back view illustrating each of the plural tabs of set of advertising materials with break-open windows thereof in their closed positions.

FIG. 9B is a top back view 320 illustrating each of the plural tabs 302, 304, 306 of set of advertising materials 2' with break-open windows 308, 310, 312 thereof in their closed positions.

In one embodiment of the invention, a break-open window 308, 310, 312 is formed by folding one end of a removable tab 302, 304, 306 over at least twice to create a "compound fold" and attaching a break-open structure 314, 316, 318 over a portion of the top and bottom of the fold, completely encircling the fold, thereby attaching it to the removable tab 302, 304, 306. In another embodiment of the present invention, a break-open 314, 316, 318 structure encircles a simple fold (i.e., removable tab 302, 304, 306 folded only once).

In another embodiment of the present invention, a break-open structure is attached to a bottom of the compound fold. The break-open structure can also be attached to a bottom of a simple fold. In such embodiments the break-open structure attaches the compound fold or simple fold directly to the removable tab. In such embodiments the break-open structure includes, but is not limited to glue, other adhesives, a compression attachment, or other types of attachments.

Figure 15:
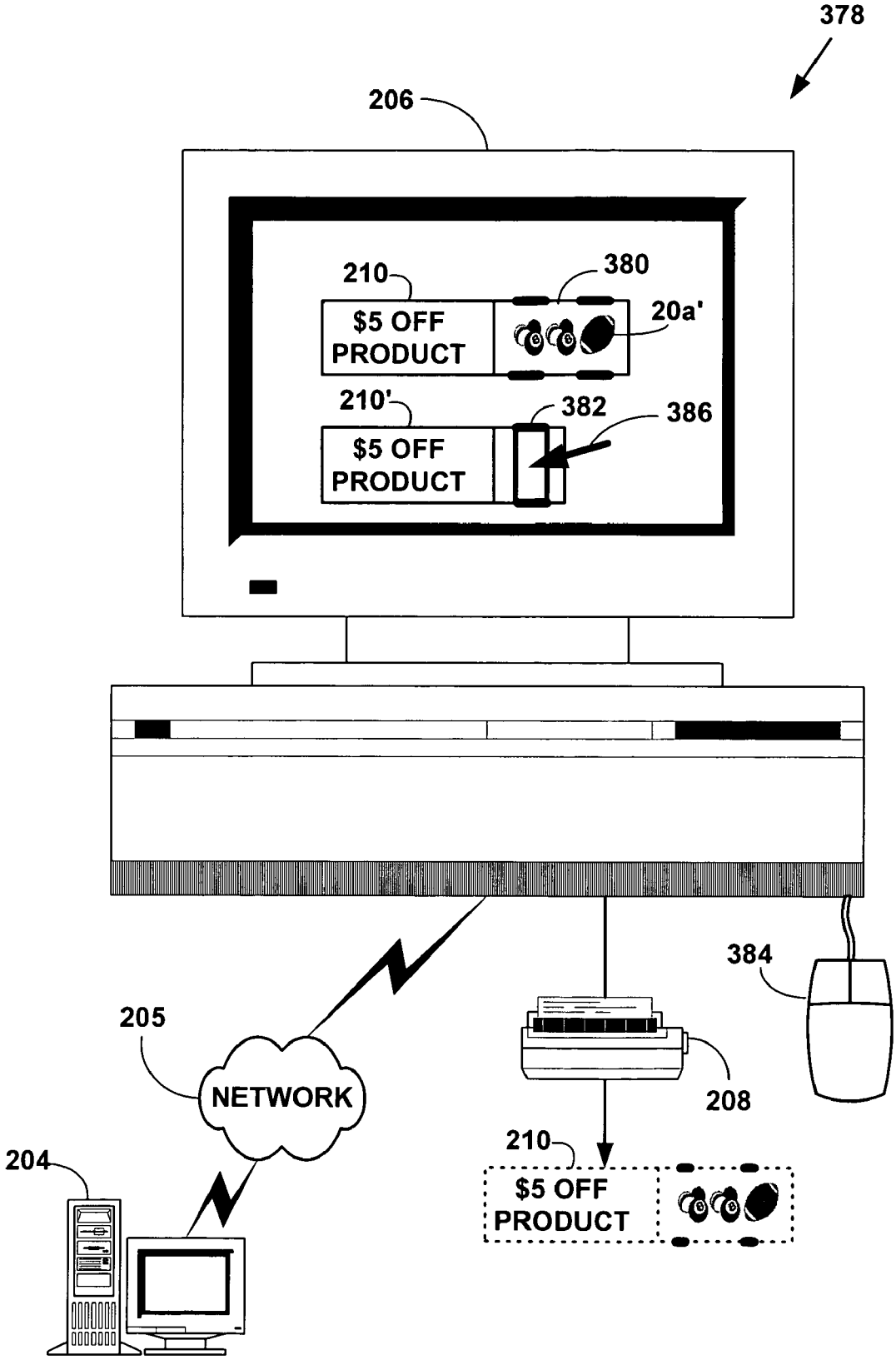
FIG. 15 is a block diagram illustrating graphical display of graphical coupons.

In another embodiment of the present invention, the set of advertising materials 2' with plural removable tabs 302, 304, 306 with break-open windows 308, 310, 312 are graphically represented 210 on terminal 206 in system 202 (FIG. 15).

However, the invention is not limited to these embodiments and other types of break-open windows and break-open structures can also be used to practice the invention.

In one embodiment of the invention, the break-open structure 314, 316, 318 includes a paper strip comprising a paper wrap. The paper strip is used to completely encircle a removable tab 302, 304, 306 and fastens on the back side of a removable tab (e.g., with glue or other adhesive, or compression attachment, etc.). The paper strip is typically a different color than the removable tab that provides contrast and helps attract a purchaser and may itself include a coupon or advertising. The paper strip is easily broken-open with a small amount of force to reveal the break-open window and indicia printed thereon.

However, the present invention is not limited to the break-open windows or break-open structures illustrated and other types of break-open windows and break open structures can also be used to practice the invention. The break-open structure can also be the same color as the removable tab and attach on the front of the removable tabs.

In one embodiment of the invention, the removable tabs 302, 304, 306 are stacked one on top of another and attached together. The set of advertising materials 2' including the removable tabs 302, 304, 306 with break-open windows 308, 310, 312 are then sold as a set to purchasers as is explained below.

In another embodiment of the present invention, the set of advertising materials 2' with plural removable tabs 302, 304, 306 with break-open windows 308, 310, 312 are graphically represented 210 on terminal 206 in system 202 (FIG. 8). The break-open windows are 308, 310, 312 are "broken-open" electronically by selecting the graphical break-open windows with a selection device (e.g., physical or graphical button, mouse, trackball, keyboard, touch screen, etc.).

Figure 9C:
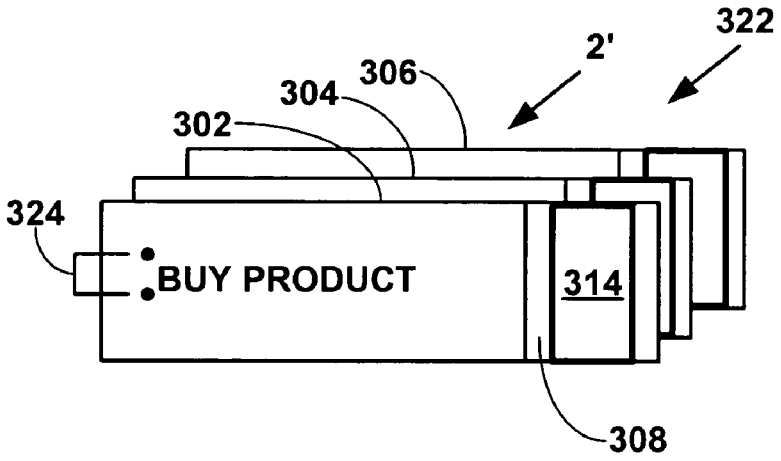
FIG. 9C is a top front view illustrating the plural tabs with break-open windows thereof in their closed positions stacked on one on top of another.

FIG. 9C is a top front view 322 illustrating a set of removable tabs 302, 304, 306 with break-open windows 308, 310, 312 thereof in their closed positions. The set of tabs are illustrated stacked on one on top of another.

The set of plural removable tabs 302, 304, 306 are attached with a connector 324, including, but not limited to, a staple, glue, compression indentation, or other suitable connector. However, other types of connectors can also be used and the invention is not limited to the connectors described.

Figure 10A:
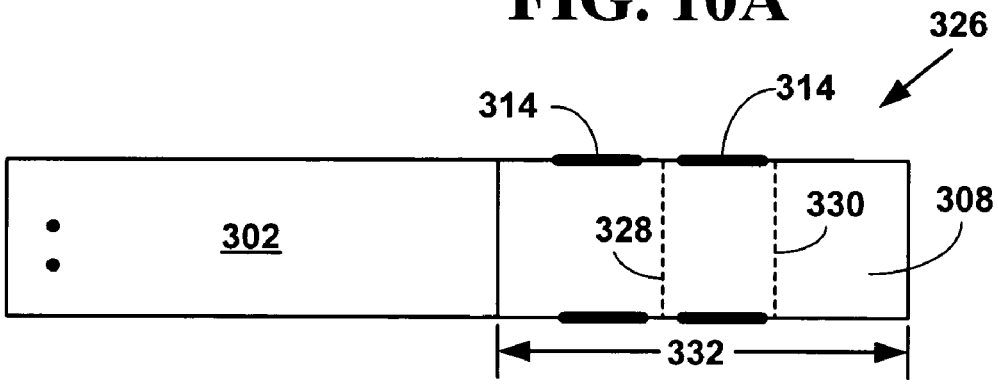
FIG. 10A is a top back view illustrating a removable tab from the set of advertising materials with its break-open window in its open position.

FIG. 10A is a top back view 326 illustrating one removable tab 302 from the set of advertising materials 2' with its break-open window 308 in its open position. A first fold line 328 and a second fold line 330 of a compound fold are illustrated. In addition, two portions of the break-open structure 314 that overlap the tab 302 and that were used to create the break-open window 308 are also illustrated. The front of the removable tab 302 includes a front panel 332 including coupons or a game piece as is described below.

Figure 10B:
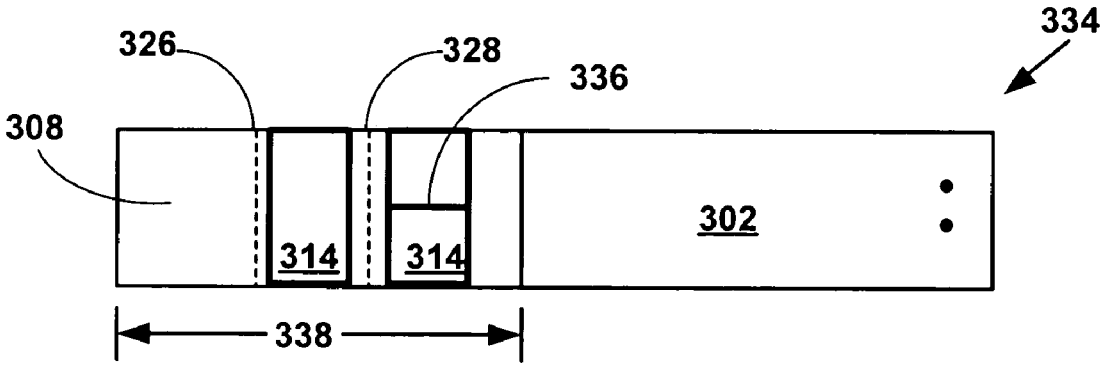
FIG. 10B is a top back view illustrating a removable tab with break-open window thereof in its open position.

FIG. 10B is a top back view 334 illustrating one removable tab 302 with break-open window 308 thereof in its open position. A connection point 336 of the break-open structure 314 used to create the break-open window 308 is also illustrated. The back of the removable tab 302 includes a back panel 338 as is described below. The other removable tabs 304, 306 in the set have identical features.

VIII. Advertising Materials Set 2'

The advertising material set 2' with plural removable tabs 302, 304, 306 can be used, for example, for cooperative promotions among different business entities. The advertising material set 2' generally comprise plural coupon cards 4' comprising a coupon set. Typical sets of coupons range from several hundred to several thousand or more. The advertising materials also include a display or flare 6 (FIG. 3) as described above for promoting sales of the coupon cards 4', the game and for identifying an award structure.

IX. Coupon Cards 4'

The advertising materials set 2' includes a predetermined number of coupon cards 4', with an award structure comprising predetermined numbers of winners of different award amounts. Without limitation on the generality of various award structures, exemplary disclosed game materials provide, for example, for two winners of $250 each, four winners of $100 each, eight winners of $50 each, ten winners of $20 each, one hundred winners of $2.00 each and two hundred and ninety winners of $1.00 each. For example, the winning coupon cards 4' are disbursed among a total of 3,078 coupon cards 4' in the entire set. The coupons have selling prices of, for example, $1.00 each.

Figure 11A:
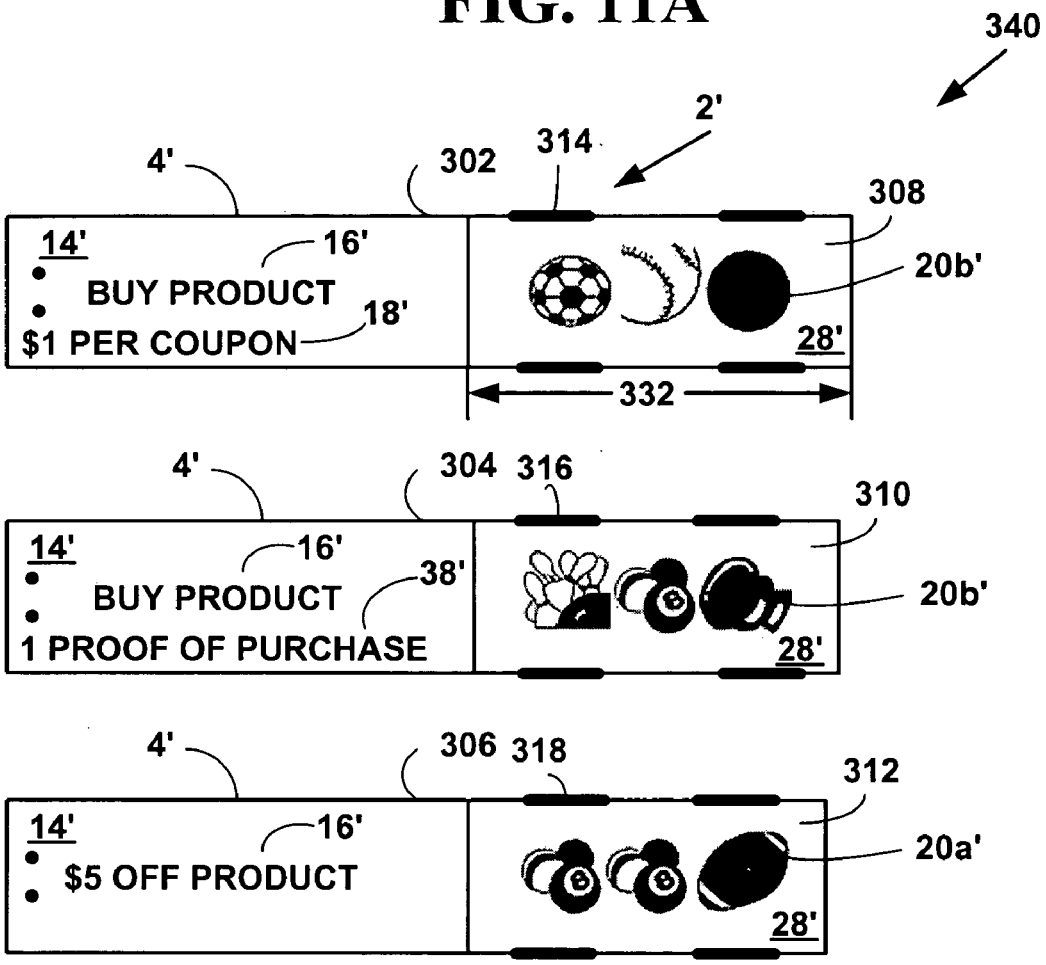
FIG. 11A is a top front view illustrating an exemplary front face of the coupons printed on the removable tabs including product advertising printed thereon with their break-open windows thereof in their open positions.

FIG. 11A is a top front view 340 illustrating an exemplary front face 14' of the coupon cards 4' printed on the set of removable tabs 302, 304, 306 including product advertising 16' printed thereon. One or more of the coupon cards 4' (e.g., printed on removable tab 302) includes a selling price 18' (e.g., $1 per coupon) for the coupon card 4'. The product advertising 16' can also comprise a "proof-of-purchase" form 38' wherein customers are required to purchase a predetermined number of coupon cards 4' in order to receive favorable pricing on an advertised product. As used herein, "product" refers to goods and/or services.

The coupon cards 4' include break-open windows 308, 310, 312 in their open positions for selectively concealing indicia 20' on a front panel 332 for determining an award, if any, for the customer. Thus, the indicia 20' include both "win" 20*a'* and "lose" indicators 20*b'*. (See FIG. 3).

Figure 11B:
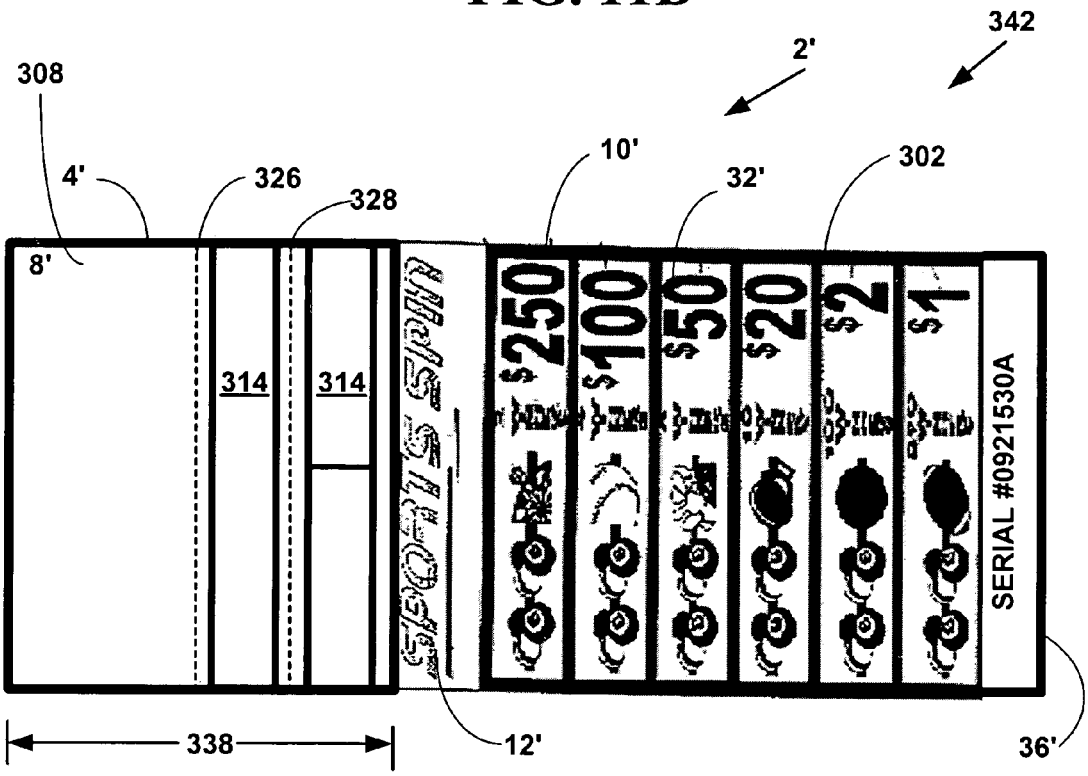
FIG. 11B is a top back view illustrating an exemplary back face with an award structure of award values printed thereon with their break-open windows thereof in their open positions.

Each indicia 20' comprises plural (e.g. three are shown) of symbols 28', with certain symbol combinations (e.g., 20*a'* a one dollar winner) comprising winners and losers (e.g., 20*b'*) associated with respective award values 32' (FIGS. 3 and 11B). The symbols 28' include graphical symbols, numbers, letters, or combinations thereof.

Various other structures and devices for selectively concealing the indicia 20' can be employed with the present invention and the present invention is not limited to break-open windows. The disclosed construction is also relatively efficient and cost effective.

FIG. 11B is a top back view 342 illustrating an exemplary back face 8' with the award structure 10' of award values 32' printed thereon. FIG. 11B is enlarged to illustrate the details of the award structure 10'. In one embodiment of the present invention, each coupon card 4' has a back face 8' with the award structure 10' of award values 32' printed thereon. The name of a promotion 12' (e.g., "Sports Spin") is also printed on the back face 8' at 10'. A serial number 36' associated with the advertising material set 2' is printed on the back face 8' of each coupon card 4'.

In one exemplary illustrated embodiment, the coupon cards 4' are paper with front and back panels providing the front and back faces 14', 8' respectively. The indicia 20' are printed on the inside face of a front panel (e.g., 332) and are selectively concealed by break-open windows 308, 310, 312 formed in the front panel by folding the back panel (e.g., 338) over twice and attaching the break-open structures (e.g., 314) over a portion of the top and bottom of the compound fold, completely encircling the fold. However, the present invention is not limited to this embodiment and other embodiments can also be used to practice the invention.

For example, the winning indicia 20*a'* on removable tab 302 is printed on the inside face of a front panel 332 and are selectively concealed by break-open window 308 formed in the front panel 332 by folding the back panel 338 over twice and attaching the break-open structure 314 over the top and bottom of the fold, completely encircling the fold.

The break-open windows 308, 310, 312 have closed and open positions respectively concealing and revealing the indicia 20'. The break-open windows 308, 310, 312 are movable between open and closed positions revealing and concealing respective indicia 20'.

X. Advertising Materials Set 2" and Coupon cards 4"

In another embodiment of the present invention, another set of advertising materials 2", coupon cards 4" printed on the plural removable tabs 302, 304, 306 do not include the award structure 10. In such an embodiment, the display or flare 6 (FIG. 3) as described above is used for promoting sales of the coupon cards 4" of a game and for identifying an award structure.

Figure 12A:
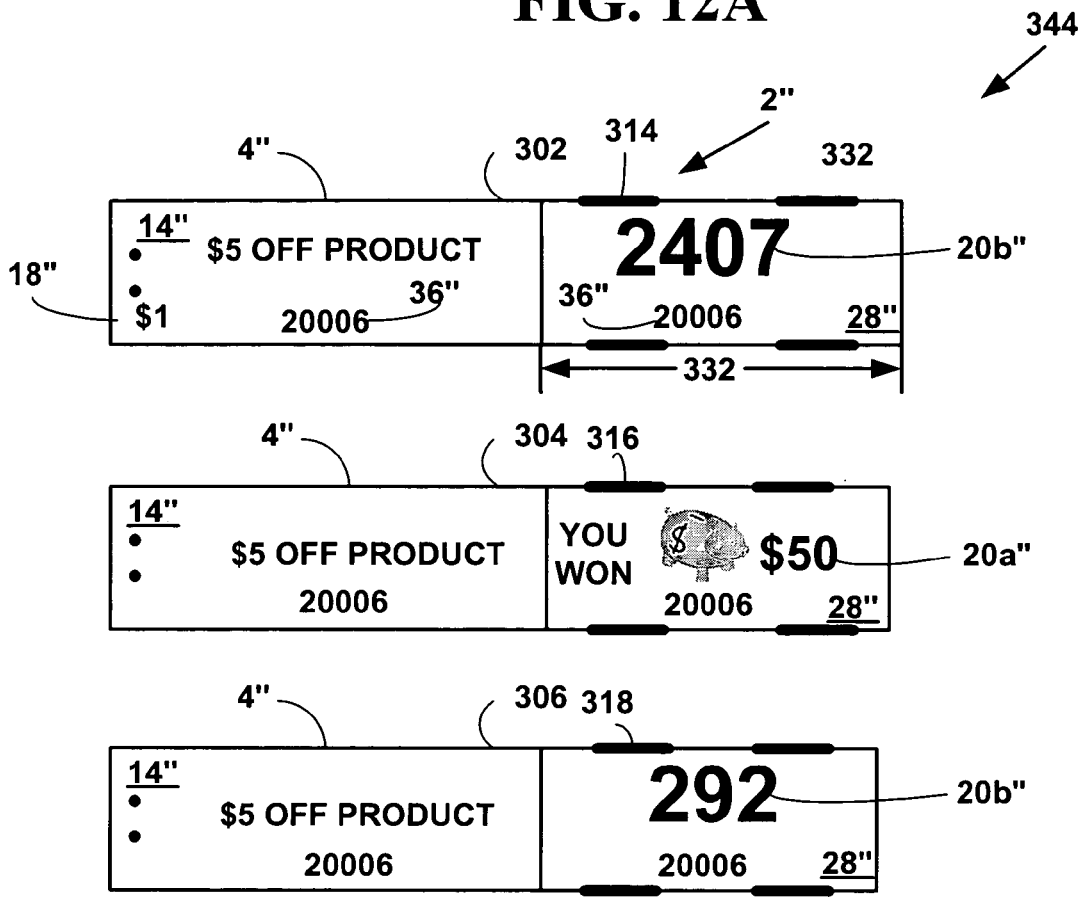
FIG. 12A is a top front view illustrating an exemplary front face of coupons printed on removable tabs including product advertising printed thereon with their break-open windows thereof in their open positions.

FIG. 12A is a top front view 344 illustrating an exemplary front face 14" of the coupon cards 4" printed on the removable tabs 302, 304, 306 including product advertising 16" printed thereon.

In one embodiment of the invention, one or more of the coupon cards 4" (e.g., on removable tab 302) includes a selling price 18" and (e.g., $1 per set of coupons) and proof-of-purchase information 38" (not illustrated in FIG. 12A) printed the coupon card 4". The coupon cards 4" include break-open windows 308, 310, 312 for selectively concealing indicia 20" for determining an award, if any, for the customer. Thus, the indicia 20" include both "win" 20*a"* and "lose" indicators 20*b* ".

In this embodiment, losing indicia 20*b"* include only numbers and winning indicia 20*a"* include graphical symbols (e.g., a piggy bank, etc.), text and/or numbers. However, the present invention is not limited to such indicia and other indicia or combinations thereof can also be used.

A serial number 36" (e.g., 20006) associated with the advertising material set 2" is printed on the front face 14" of each coupon card 4" and on the front panel (e.g., 332) of each coupon card 4" comprising the break-open windows 308, 310, 312. The serial number may also be printed on the back panel (e.g., 338).

Figure 12B:
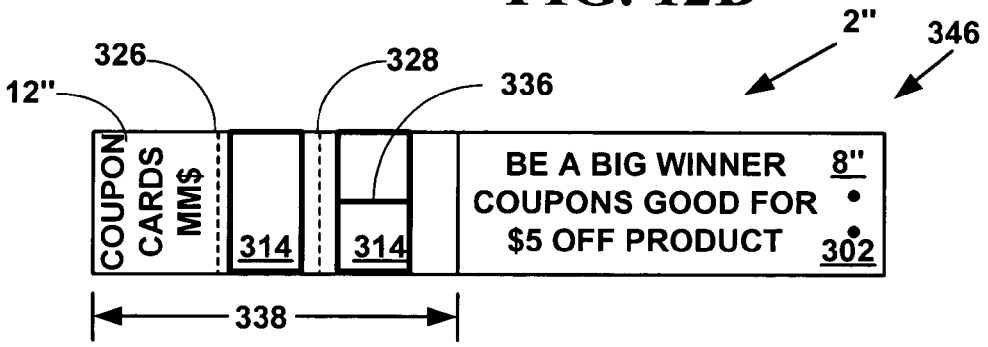
FIG. 12B is a top back view illustrating an exemplary back face of a coupon with their break-open windows thereof in their open positions.

FIG. 12B is a top back view 346 illustrating an exemplary back face 8" of a coupon card 4". In this embodiment, each coupon card 4" has a back face 8" with instructions printed thereon. The name of a promotion 12" (e.g., "Coupon Cards, Millionaire Madness $" or "MM$") is also printed on the back face 8". In this illustration, no awards on printed on the back face 8". However, awards could be printed on the back face 8".

In another embodiment of the present invention, the set of advertising materials 2" with plural removable tabs 302, 304, 306 with break-open windows 308, 310, 312 are graphically represented 210 on terminal 206 in system 202 (FIG. 8).

XI. Cooperative Promotional Methodology

Figure 13:
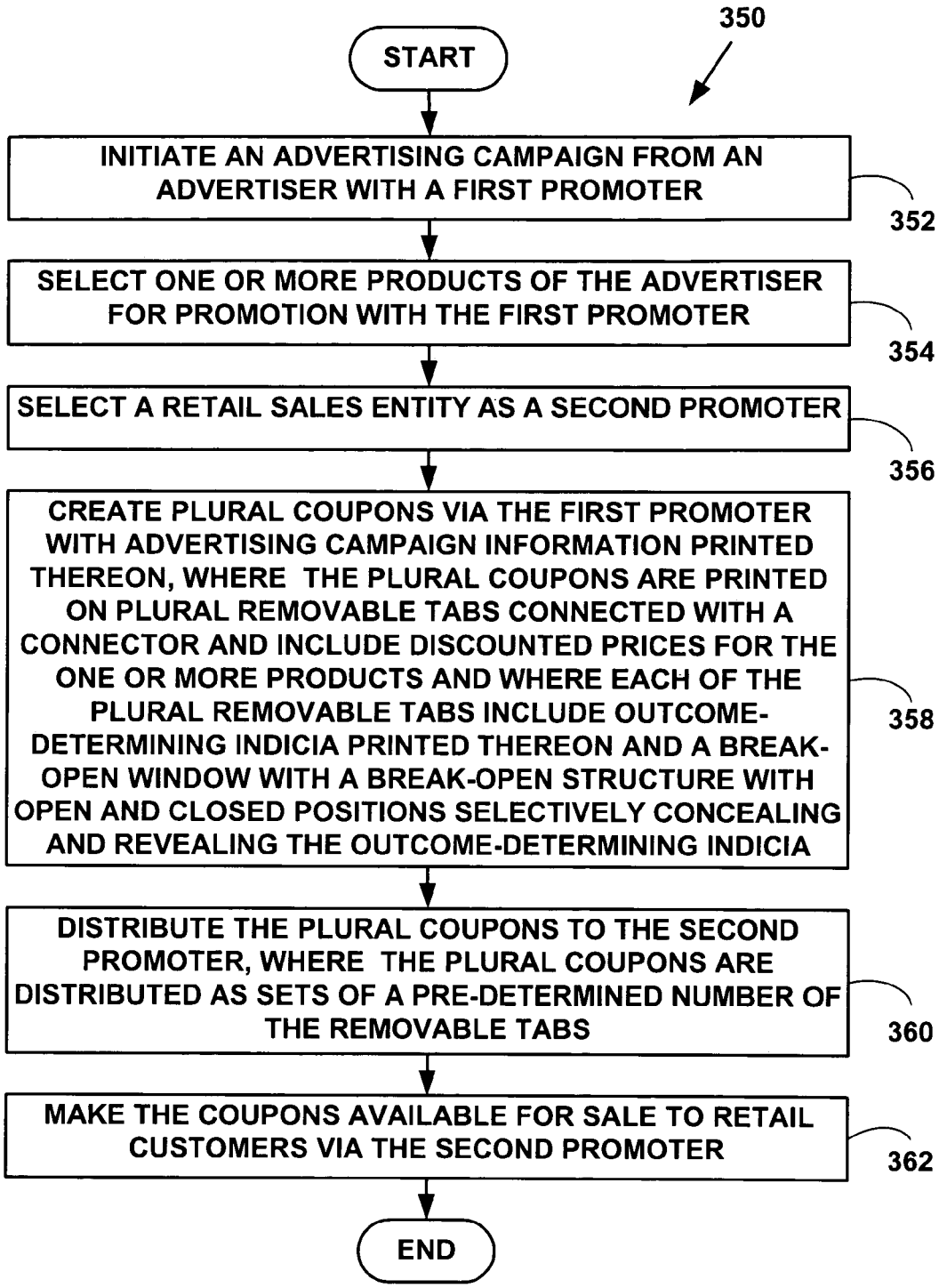
FIG. 13 is a flow diagram illustrating a method for cooperative advertising.

FIG. 13 is a flow diagram illustrating a Method 350 for cooperative advertising. At Step 352, an advertising campaign is initiated by an advertiser 40 with a first promoter 44. At Step, 354, one or more products of the advertiser 40 are selected for promotion by the first promoter 44. At Step 356, a retail sales entity is selected as a second promoter 50. At Step 358, plural coupon cards 4', 4" are created via the first promoter 44 with advertising campaign information printed thereon. The plural coupon cards 4', 4" are printed on plural removable tabs 302, 304, 306 connected with a connector 324. The plural coupon cards 4', 4" include discounted prices for the one or more products. Each of the plural removable tabs 302, 304, 306 include outcome-determining indicia 20', 20" printed thereon and a break-open window 308, 310, 312 with a break-open structure 314, 316, 318 with open and closed positions selectively concealing and revealing the outcome-determining indicia 20', 20". At Step 360, the plural coupon cards 4', 4" are distributed to the second promoter 50. The plural coupon cards 4', 4" are distributed as sets of a pre-determined number of the removable tabs (e.g., three, etc.) connected with the connector 324. At Step 362, the coupon cards 4', 4" are made available for sale to retail customers 54 via the second promoter 50.

Method 350 may further comprise additional steps including accepting coupon cards 4', 4" bearing winning indicia 20*a*', 20*a*" from retail customers 54 via the second promoter 50 and distributing awards to the retail customers 54 via the second promoter 50.

Method 350 may further comprise additional steps including accepting coupon cards 4', 4" bearing losing indicia 20*b*', 20*b*" from retail customers via the second promoter 50 for the purchase of one or more products of the first promoter 44 at a discounted price and returning the accepted coupon cards 4', 4" back to the first promoter 44.

Method 350 may further comprise additional steps including accepting electronically, a graphical coupon 210 from terminal 206 bearing winning indicia 20*a*', 20*a*" from retail customers 54 via the second promoter 50 and distributing awards electronically to the retail customers 54 (e.g., via customer account, etc.) via the second promoter 50.

Method 350 may further comprise additional steps including accepting electronically, a graphical coupon 210 from terminal 206 bearing losing indicia 20*b*', 20*b*" from retail customers 54 via the second promoter 50 for the purchase of one or more products of the first promoter 44 at a discounted price, and returning the accepted graphical coupons electronically back to the first promoter 44.

Method 350 may further comprise additional steps including accepting printed coupons bearing winning indicia 20*a*', 20*a*" from retail customers 54 via the second promoter 50 and distributing awards to the retail customers 54 via the second promoter 50, where the coupons were printed via printer 208 and returning the accepted printed coupons back to the first promoter 44.

Method 350 may further comprise additional steps including accepting printed coupons bearing losing indicia 20*b*', 20*b*" from retail customers 54 via the second promoter 50 for the purchase of one or more products of the first promoter 44 at a discounted price, where the coupons were printed via printer 208 and returning the accepted printed coupons back to the first promoter 44.

XII. Electronic Cooperative Promotional Methodology

Figure 14:
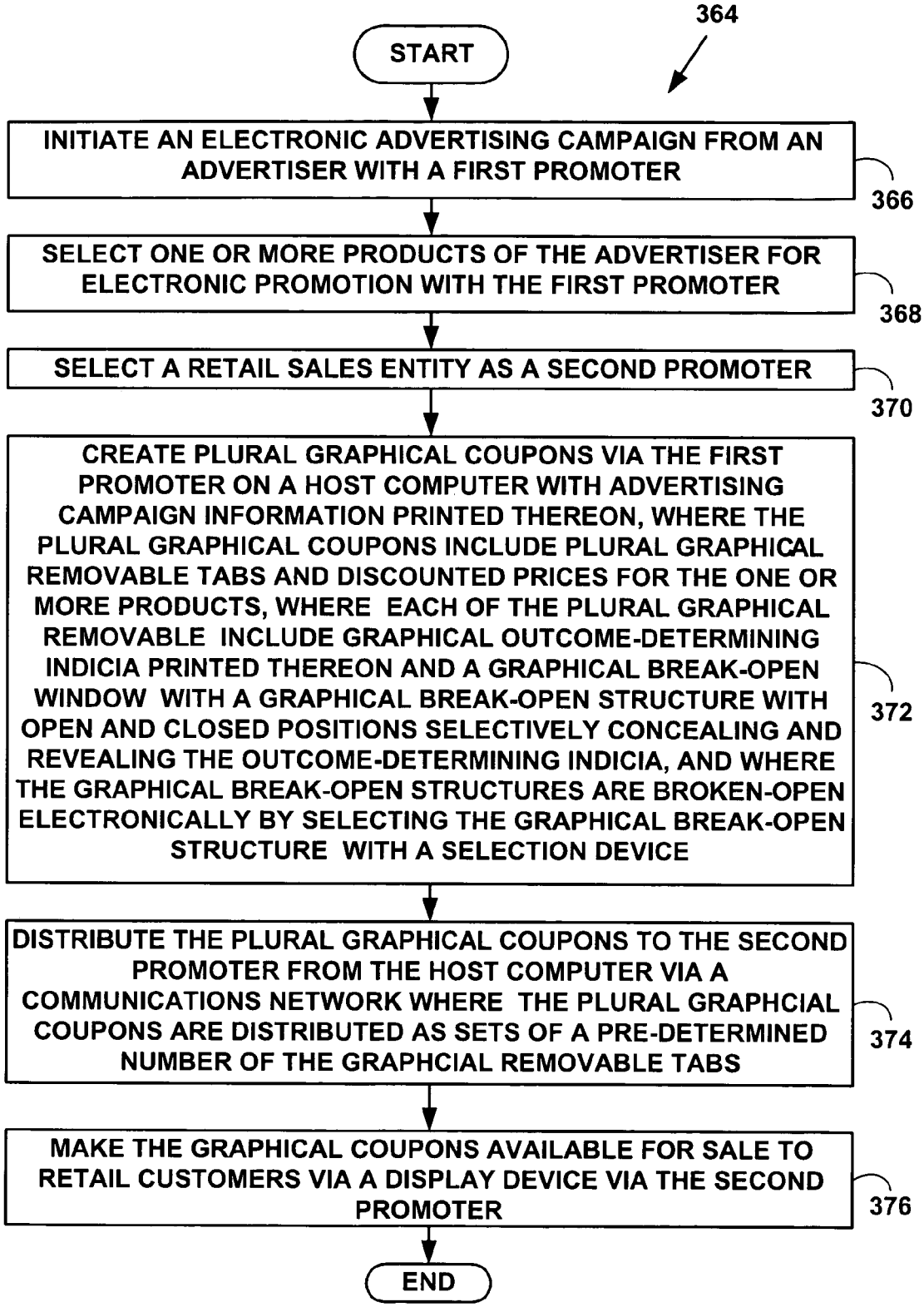
FIG. 14 is a flow diagram illustrating an electronic method for cooperative advertising.

FIG. 14 is a flow diagram illustrating a Method 364 for cooperative advertising.

At Step 366, an electronic advertising campaign is initiated by an advertiser 40 with a first promoter 44. At Step, 368, one or more products of the advertiser 40 are selected for electronic promotion by the first promoter. At Step 370, a retail sales entity is selected as a second promoter 50.

At Step 372, plural graphical coupons 210 are electronically created from coupon cards 4' or 4" (or 4, 104) on host computer 204 with the first promoter's advertising campaign information electronically printed thereon. The plural graphical coupons 210 include plural graphical removable tabs 302, 304, 306. The plural graphical coupons 210 include discounted prices for the one or more products. Each of the plural graphical removable tabs 302, 304, 306 include graphical outcome-determining indicia 20', 20" printed thereon and a graphical break-open window 308, 310, 312 with a graphical break-open structure 314, 316, 318 with open and closed positions selectively concealing and revealing the outcome-determining indicia 20', 20". The graphical break-open structures 314, 316, 318 are "broken-open" (or "scratched-off") electronically by selecting the break-open structure 314, 316, 318 with a selection device (e.g., physical or graphical button, mouse, trackball, keyboard, touch screen, etc.). The plural graphical coupons 210 include first promoter 44 information input via merchant terminal 212 and input device 214.

At Step 374, the plural graphical coupons 210 are made available to the second promoter 50 from the host computer 204 via a communications network 205. The plural graphical coupons 210 are distributed as sets of a pre-determined number of the graphical removable tabs (e.g., three, etc.). At Step 376, the graphical coupons 210 are made available for sale to retail customers 54 via the second promoter 50 via local display terminal 206 or other display device (e.g., personal digital/data assistant (PDA), mobile phone, etc.)

Method 364 may further comprise additional steps including accepting electronically, a graphical coupon 210 from terminal 206 bearing winning indicia 20*a*', 20*a*" from retail customers 54 via the second promoter 50 and distributing awards electronically (e.g., to a customer account, etc.) to the retail customers 54 via the second promoter 50.

Method 364 may further comprise additional steps including accepting electronically, a graphical coupon 210 from terminal 206 bearing losing indicia 20*b*', 20*b*" from retail customers 54 via the second promoter 50 for the purchase of one or more products of the first promoter 44 at a discounted price, and returning the accepted graphical coupons electronically back to the first promoter 44.

Method 364 may further comprise additional steps including accepting printed coupons 210 bearing winning indicia 20*a*', 20*a*" from retail customers 54 via the second promoter 50 and distributing awards to the retail customers 54 via the second promoter 50, where the printed coupons 210 are printed via printer 208 and returning the accepted printed coupons 210 back to the first promoter 44.

Method 364 may further comprise additional steps including accepting printed coupons 210 bearing losing indicia 20*b*', 20*b*" from retail customers 54 via the second promoter 50 for the purchase of one or more products of the first promoter 44 at a discounted price, where the printed coupons 210 are printed via printer 208 and returning the accepted printed coupons back to the first promoter 44.

FIG. 15 is a block diagram 378 illustrating graphical display of graphical coupons 210. Two graphical coupons 210, 210' are illustrated, a first 380 in which the break-open structure is in the open-position and a second 382 in which the break-open structure is still in the closed-position. A selection device 384 illustrated as a mouse is used to send a selection input.

The graphical break-open structures is "broken-open" (or "scratched-off") electronically by selecting the break-open structure (illustrated as a mouse cursor with an arrow) via a selection device and sending a selection input 386 (e.g., a mouse click).

The set of advertising materials 2, 102 can also be displayed graphically and used with Method 364. Similarly, the sets of advertising materials 2' and 2" can also be used with Method 96 of FIG. 4, Method 98 of FIG. 5 and/or Method 202 of FIG. 8. However, the present invention is not limited to these methods and these sets of advertising materials 2' and 2" can also be used with other electronic and non-electronic advertising methods.

It should be understood that the architecture, components, processes, methods and systems described herein are not related or limited to any particular type of system, unless indicated otherwise. Various types of general purpose or specialized systems may be used with or perform operations in accordance with the teachings described herein.

In view of the wide variety of embodiments to which the principles of the present invention can be applied, it should be understood that the illustrated embodiments are exemplary only, and should not be taken as limiting the scope of the present invention. For example, the steps of the flow diagrams may be taken in sequences other than those described, and more or fewer elements may be used in the block diagrams.

The claims should not be read as limited to the described order or elements unless stated to that effect. In addition, use of the term "means" in any claim is intended to invoke 35 U.S.C. §112, paragraph 6, and any claim without the word "means" is not so intended. Therefore, all embodiments that come within the scope and spirit of the following claims and equivalents thereto are claimed as the invention.

I claim:

1. A cooperative promotional advertising material set, comprising:

a plurality of removable tabs connected with a connector, wherein selected ones of the plurality of removable tabs include a coupon printed thereon for discounted prices on one or more products, and wherein each of the plurality of removable tabs include outcome-determining indicia printed thereon and a break-open window with a break-open structure with open and closed positions selectively concealing and revealing the outcome-determining indicia;

a plurality of the removable tabs having losing indicia printed thereon;

a plurality of the removable tabs having winning indicia associated with respective awards printed thereon;

proof-of-purchase information printed on the plurality of removable tabs providing additional discounts on the one the or more products or other products; and a point-of-purchase promotional display with said indicia and the awards associated therewith printed thereon.

2. The cooperative promotional advertising material set of claim 1 wherein the break-open window is formed by folding one end of a removable tab over at least twice to create a compound fold and attaching a break-open structure over a top and a bottom of the compound fold, thereby completely encircling the compound fold and attaching it to the removable tab.

3. The cooperative promotional advertising material set of claim 1 wherein the break-open window is formed by folding one end of a removable tab over at least twice to create a compound fold and attaching a break-open structure to a bottom of compound fold, wherein the break-open structure attaches the compound fold directly to the removable tab.

4. The cooperative promotional advertising material set of claim 1 wherein the break-open structure includes a paper strip.

5. The cooperative promotional advertising material set of claim 1 wherein the break-open structure includes a paper strip with a color different than a removable tab it is attached to.

6. The cooperative promotional advertising material set of claim 1 wherein the plurality of removable tabs include at least three removable tabs connected with a staple.

7. The cooperative promotional advertising material set of claim 1 wherein each of the indicia comprises a plurality of individual symbols comprising a respective symbol combination indicating a winning or a losing combination.

8. The cooperative promotional advertising material set of claim 1, wherein each coupon printed on a removable tab includes:

a font face with the advertising printed thereon on an advertising end and the indicia printed thereon on an indicia end;

a back face with the awards associated therewith advertising printed thereon; and a break-open window formed on the front face by folding the indicia end of the coupon over at least twice to create a compound fold and attaching a break-open structure over a top and a bottom of the compound fold, thereby completely encircling the compound fold and attaching it to the removable tab, wherein the compound fold does not obstruct the advertising printed on the advertising end of the front face or the awards associated with the advertising printed on the back face.

9. The cooperative promotional advertising material set of claim 1, wherein each coupon printed on a removable tab includes:

a font face with the advertising printed thereon on an advertising end and the indicia printed thereon on an indicia end;

a back face with additional advertising printed thereon; and a break-open window formed on the front face by folding the indicia end of the coupon over at least twice to create a compound fold and attaching a break-open structure over a top and a bottom of the compound fold, thereby completely encircling the compound fold and attaching it to the removable tab, wherein the compound fold does not obstruct the advertising printed on the advertising end of the front face or the additional advertising printed on the back face.

10. The cooperative promotional advertising material set of claim 1, wherein each coupon printed on a removable tab includes:

a font face with the advertising printed thereon on an advertising end and the indicia printed thereon on an indicia end;

a back face with contest information printed thereon; and a break-open window formed on the front face by folding the indicia end of the coupon over at least twice to create a compound fold and attaching a break-open structure over a top and a bottom of the compound fold, thereby completely encircling the compound fold and attaching it to the removable tab, wherein the compound fold does not obstruct the advertising printed on the advertising end of the front face or the contest information printed on the back face.

11. The cooperative promotional advertising material set of claim 1 wherein each coupon and the promotional display have a corresponding serial number printed thereon.

12. The cooperative promotional advertising material set of claim 1 wherein the indicia comprise a plurality of symbols including, numbers, letters, graphical symbols or combinations thereof.

13. The cooperative promotional advertising material set of claim 1 wherein the indicia comprising a plurality of combinations of symbols indicating winning and losing combinations.

14. An electronic cooperative promotional advertising material set, comprising:

a plurality of graphical removable tabs connected with a graphical connector, wherein selected ones of the plurality of graphical removable tabs include a graphical coupon printed thereon for discounted prices on one or more products, and wherein each of the plurality of graphical removable tabs include outcome-determining indicia printed thereon and a graphical break-open window with a graphical break-open structure with open and closed positions selectively concealing and revealing the outcome-determining indicia, wherein the graphical break-open structure is broken open upon selection by a selection input;

a plurality of the graphical removable tabs having losing indicia printed thereon;

a plurality of the graphical removable tabs having winning indicia associated with respective awards printed thereon;

proof-of-purchase information printed on the plurality of graphical removable tabs providing additional discounts on the one the or more products or other products; and a graphical point-of-purchase promotional display with said indicia and the awards associated therewith printed thereon.

15. The electronic cooperative promotional advertising material set of claim 14 wherein the selection input includes a selection input generated by a physical or graphical button, mouse, trackball, keyboard or a touch screen.

16. A cooperative promotional advertising material set, comprising:

a plurality of removable tabs, wherein each of the plurality of removable tabs include a coupon printed thereon for discounted prices on one or more products, wherein each of the plurality of removable tabs include outcome-determining indicia printed thereon and a break-open window with a break-open structure with open and closed positions selectively concealing and revealing the outcome-determining indicia, and wherein each of the plurality of removable tabs include a list of respective awards printed thereon;

a plurality of the removable tabs having losing indicia printed thereon;

a plurality of the removable tabs having winning indicia associated with the respective awards having printed thereon;

proof-of-purchase information printed on the plurality of removable tabs; and a promotional display with the winning indicia and the awards associated therewith printed thereon.

17. The cooperative promotional advertising material set of claim 16 wherein the break-open window is formed by folding one end of a removable tab over at least twice to create a compound fold and attaching a break-open structure over a top and a bottom of the compound fold, thereby completely encircling the compound fold and attaching it to the removable tab.

18. The cooperative promotional advertising material set of claim 16, wherein each coupon printed on a removable tab includes:

a font face with the advertising printed thereon on an advertising end and the indicia and printed thereon on an indicia end;

a back face with the list of respective awards printed thereon; and a break-open window formed on the front face by folding the indicia end of the coupon over at least twice to create a compound fold and attached a break-open structure over a top and a bottom of the compound fold, thereby completely encircling the compound fold and attaching it to the removable tab, wherein the compound fold does not obstruct the advertising printed on the advertising end of the front face or the list of respective awards printed on the back face.

19. A co-promotional advertising method, comprising:

initiating an advertising campaign from an advertiser with a first promoter;

selecting one or more products of the advertiser for promotion by the first promoter;

selecting a retail sales entity as a second promoter;

creating a plurality of coupons with an advertising campaign information printed thereon, wherein the plurality of coupons are printed on plurality of removable tabs connected with a connector, wherein the plurality of coupons include discounted prices for the one or more products, and wherein each of the plurality of removable tabs include outcome-determining indicia printed thereon and a break-open window with a break-open structure with open and closed positions selectively concealing and revealing the outcome-determining indicia;

distributing a set of the plurality of coupons to the second promoter, wherein the plurality of coupons are distributed as sets of a pre-determined number of the removable tabs connected with the connector; and making the coupons available for sale to retail customers via the second promoter.

20. The co-promotional advertising method of claim 19, wherein each coupon printed on a removable tab includes:

a font face with the advertising campaign information printed thereon on an advertising end and the indicia printed thereon on an indicia end;

a back face with the awards associated therewith advertising campaign printed thereon; and a break-open window formed on the front face by folding the indicia end of the coupon over at least twice to create a compound fold and attaching a break-open structure over a top and a bottom of the compound fold, thereby completely encircling the compound fold and attaching it to the removable tab, wherein the compound fold does not obstruct the advertising campaign information printed on the advertising end of the front face or the awards associated with the advertising campaign printed on the back face.

21. The co-promotional advertising method of claim 19 wherein the break-open window is formed by folding one end of a removable tab over at least once to create a simple fold and attaching a break-open structure over a top and a bottom of the simple fold, thereby completely encircling the simple fold and attaching it to the removable tab.

22. The co-promotional advertising method of claim 19 further comprising:

accepting coupons bearing winning indicia from retail customers via the second promoter; and distributing awards to the retail customers via the second promoter.

23. The co-promotional advertising method of claim 19 further comprising:

accepting coupons bearing losing indicia from retail customers via the second promoter for the purchase of one or more products of the first promoter at a discounted price; and returning the accepted coupons back to the first promoter.

24. An electronic co-promotional advertising method, comprising:

initiating an electronic advertising campaign from an advertiser with a first promoter;

selecting one or more products of the advertiser for electronic promotion with the first promoter;

selecting a retail sales entity as a second promoter;

creating a plurality of graphical coupons on a host computer via the first promoter with advertising campaign information electronically printed thereon, wherein the plurality of graphical coupons are printed on plurality of graphical removable tabs, wherein the plurality of graphical coupons include discounted prices for the one or more products, and wherein each of the plurality of graphical removable tabs include outcome-determining indicia printed thereon and a graphical break-open window with a graphical break-open structure with open and closed positions selectively concealing and revealing the outcome-determining indicia, wherein the graphical break-open structure is graphically broken-open upon selection by a selection input;

distributing a set of the plurality of graphical coupons to the second promoter from the host computer via a communications network, wherein the plurality of graphical coupons are distributed as sets of a predetermined number of the graphical removable tabs; and making the graphical coupons available for sale to retail customers via the second promoter via a display device.

25. The electronic co-promotional advertising method of claim 24 further comprising:

accepting graphical coupons bearing winning indicia from retail customers via the second promoter; and distributing awards electronically to the retail customers via the second promoter.

26. The electronic co-promotional advertising method of claim 24 further comprising:

accepting graphical coupons bearing losing indicia from retail customers via the second promoter for the purchase of one or more products of the first promoter at a discounted price; and returning electronically the accepted graphical coupons back to the first promoter.

27. The electronic co-promotional advertising method of claim 24 further comprising:

accepting printed coupons bearing winning indicia from retail customers via the second promoter, wherein the printed coupons are printed via a printer attached to the communications network;

distributing awards to the retail customers via the second promoter; and returning the accepted printed coupons back to the first promoter.

28. The electronic co-promotional advertising method of claim 24 further comprising:

accepting printed coupons bearing losing indicia from retail customers via the second promoter for the purchase of one or more products of the first promoter at a discounted price, wherein the printed coupons are printed via a printer attached to the communications network; and returning the accepted printed coupons back to the first promoter.

29. The electronic co-promotional advertising method of claim 24 further comprising a computer readable medium having stored therein instructions for causing a processor to execute the steps of the method.

30. The electronic co-promotional advertising method of claim 24 wherein the selection input includes a selection input generated by a physical or graphical button, a mouse, trackball, keyboard or a touch screen.

* * * * *